US011439292B2

(12) United States Patent
Ha et al.

(10) Patent No.: US 11,439,292 B2
(45) Date of Patent: Sep. 13, 2022

(54) SYSTEM AND METHOD FOR RECOMMENDING OBJECT PLACEMENT

(71) Applicant: Media Group Co., LTD., Foshan (CN)

(72) Inventors: Thanh Huy Ha, Milpitas, CA (US); Yi Chen, San Mateo, CA (US); Yunke Tian, Santa Clara, CA (US)

(73) Assignee: MIDEA GROUP CO. LTD., Foshan (CN)

( * ) Notice: Subject to any disclaimer, the term of this patent is extended or adjusted under 35 U.S.C. 154(b) by 322 days.

(21) Appl. No.: 16/673,831

(22) Filed: Nov. 4, 2019

(65) Prior Publication Data

US 2021/0127943 A1 May 6, 2021

(51) Int. Cl.
*A47L 15/42* (2006.01)
*A47L 15/00* (2006.01)

(52) U.S. Cl.
CPC ..... *A47L 15/4297* (2013.01); *A47L 15/0097* (2013.01); *A47L 15/427* (2013.01); *A47L 15/4274* (2013.01); *A47L 15/4293* (2013.01); *A47L 15/4295* (2013.01)

(58) Field of Classification Search
None
See application file for complete search history.

(56) References Cited

U.S. PATENT DOCUMENTS

2018/0214001 A1 8/2018 Wobkemeier

FOREIGN PATENT DOCUMENTS

| | | | | |
|---|---|---|---|---|
| CN | 107411672 A | | 12/2017 | |
| CN | 107729816 A | | 2/2018 | |
| CN | 107977080 A | | 5/2018 | |
| CN | 109528138 A | * | 3/2019 | ..... A47L 15/42 |
| CN | 109528138 A | | 3/2019 | |
| CN | 109998438 A | | 7/2019 | |

OTHER PUBLICATIONS

English Machine Translation of CN 109528138A (Year: 2019).*
Midea Group Co., Ltd., International Search Report/Written Opinion, PCT/CN2020/119075, dated Dec. 30, 2020, 9 pgs.

* cited by examiner

*Primary Examiner* — Natasha N Campbell
*Assistant Examiner* — Pradhuman Parihar
(74) *Attorney, Agent, or Firm* — Morgan, Lewis & Bockius LLP

(57) ABSTRACT

System and method for providing visual-aided placement recommendation includes obtaining images of a rack configured to hold objects inside a chamber, placement of the plurality of objects on the rack being subject to preset constraints corresponding to characteristics of respective objects of the plurality of objects relative to physical parameters of respective locations on the rack; analyzing the images to determine whether the preset constraints have been violated by placement of objects on the rack; and in accordance with a determination that at least one preset constraint has been violated, generating a first output providing a guidance on proper placement of the first object on the rack that complies with the one or more preset constraints, in accordance with the physical characteristics of the first object relative to the physical parameters of the respective locations on the rack, taking into account of other objects already placed on the rack.

14 Claims, 11 Drawing Sheets

Front view

Side view

SYSTEM AND METHOD FOR RECOMMENDING OBJECT PLACEMENT

FIELD OF THE TECHNOLOGY

The present disclosure relates to the field of objects placement recommendation, and in particular, to systems and methods for automatically providing recommendations of optimized placement of objects with preset constraints in a home appliance (e.g., a dishwasher).

BACKGROUND OF THE TECHNOLOGY

Conventional home appliances, such as dishwashers, rely on user manually loading the dishes. However, the user rarely pays attention to the instructions associated with the products to be washed or the instructions listed on the manual of the dishwasher to load the dishes. In fact, the way of loading dishes into a dishwasher can significantly impact the performance of the washing process in terms of washing quality, resource consumption (water, energy, soap, etc.), and time consumption. Sometimes, improper loading, such as loading dishes onto wrong racks (e.g., top or bottom), at wrong location on a rack, oriented in wrong directions, and/or loading dishwasher-unsafe objects into dishwasher may cause damages to the dishes and even cause malfunction to the dishwasher. For example, improper loading may clog water draining system, or cause parts to melt during drying process, thus affect the lifespan of the dishwasher. As such, these conventional home appliances require the user to read, understand, and practice the knowledge and or gain significant experience regarding how to properly load dishes into the dishwasher. Even if the user is willing to check the dishwasher manual or other online resources (e.g., images or videos that visually demonstrate how to load the dishwasher) to learn how to properly load the dishwasher, it is inconvenient for the user to hold and load the dishes while checking the manual or the online resources. Such process may be unintuitive, cumbersome, and interruptive, leaving the user frustrated and struggled to translate and follow the loading plan demonstrated from another media to loading the dishwasher in the real kitchen space.

For these reasons, improved methods and systems for assisting the user to load dishes on a rack of the dishwasher, and providing recommendations and guidance with such loading process are desirable.

SUMMARY

Accordingly, there is a need for a method and system to assist the user with loading dishes properly and efficiently into the dishwasher, e.g., via a visual-aided recommendation system that provides intuitive and convenient visual or audio guidance and/or recommendation related to a proper dishwasher loading.

The embodiments described below provide systems and methods for providing visual-aided assistance to the user for properly load dishes in a dishwasher. The visual-aided assistance uses one or more built-in cameras installed on the dishwasher and/or one or more cameras on the user's mobile device to capture videos and/or images of the dishwasher chamber. Without requiring any user input to initiate the image capturing process or to request for recommendation or guidance for loading dishes into the dishwasher, the cameras can be initiated in response to various triggering events, such as when the system detects that the user opens the dishwasher door (e.g., indicating the user is going to load dishes on a rack in the dishwasher), when the system detects that the user pushes the rack back in (e.g., indicating that the user has completed loading the dishes and is about to start the washing process), and/or the system (e.g., the user's mobile device) detects that the user has launched the application on the user's mobile device.

After capturing the images, the placement recommendation system automatically starts to analyze the images to recognize one or more characteristics (e.g., size, shape, orientation, and/or materials) of the dishes, and generate recommendation and/or guidance regarding how to properly load dishes and/or how to correct the improper loading of one or more existing dishes on the rack. The recommendation and/or guidance can be provided via visual output (e.g., display on the dishwasher and/or on the user's mobile device display screen), audio output (e.g., speaker on the dishwasher and/or speaker of the user's mobile device), and/or other more intuitive and interactive visual cues in the dishwasher (e.g., shining a laser light towards the optimized location(s) on the rack to guide the user to place the dish on such location(s)). Thus, no additional user input is required to instruct the placement recommendation system to start performing the image analysis and running various algorithms as discussed herein to start performing image analysis and running various algorithms as discussed herein to generate recommendations. Such visual-aided placement recommendations can effectively and efficiently guide the user to properly load dishes in the dishwasher, thus avoiding damaging dishes and/or the dishwasher due to improper dish placement.

Further, the recommendation processes as discussed herein may not need any direct interaction between the user's hand and the dishwasher or the mobile phone (e.g., the camera is triggered by certain triggering events, and the recommendation analysis is automatically started following capturing the one or more images). This is convenient when the user's hands are occupied by the dishes, greasy from the dirty dishes, or inconvenient to interact with the dishwasher or the mobile phone. For example, the user may need loading suggestions while holding a dish in his or her hand, or when the user has greasy hands from the dirty dishes, or the user may be multi-tasking, checking his or her phone or watching TV and paying minimum attention to loading dishes in the dishwasher. The recommendation system discussed herein can automatically start the analysis and recommendation processes following the camera capturing the images without requiring any additional user input. In some embodiments, the camera capturing functions and/or the initiation of the recommendation processes may also controlled by user's voice input, thus completely freeing the user's hands from such tasks.

As disclosed herein, in some embodiments, a method of providing visual-aided placement recommendation is performed at a device (such as, a dishwasher or a mobile phone) having a camera and one or more output devices, one or more processors, and memory. The method includes obtaining one or more images of a rack configured to hold a plurality of objects in position while preset operations are performed on the plurality of objects inside a chamber, wherein placement of the plurality of objects on the rack are subject to one or more preset constraints corresponding to one or more characteristics of respective objects of the plurality of objects relative to one or more physical parameters of respective locations on the rack when the rack is placed within the chamber during the preset operations; analyzing the one or more images to determine whether the one or more preset constraints have been violated by placement of one or more objects on the rack; and in accordance with a determination that at least one of the one or more preset constraints has been violated by respective placement of at least a first object on the rack, generating a first output providing a guidance on proper placement of the first object on the rack that complies with the one or more preset constraints, wherein the first output is generated by the device in accordance with the one or more physical characteristics of the first object relative to the one or more physical parameters of the respective locations on the rack, taking into account of one or more other objects already placed on the rack.

In some embodiments, a method is performed at a device (such as, a dishwasher or a mobile phone) having a camera, one or more output devices, one or more processors, and memory. The method comprises detecting a triggering event for initiating the camera to capture one or more images of a mounting rack inside a chamber of a machine. In some embodiments, the mounting rack is configured to hold one or more objects at one or more locations on the mounting rack in accordance with one or more preset constraints (e.g., certain types of dishware are to be placed on top or bottom rack of the dishwasher, or dishware made of certain materials are not dishwasher-safe thus are not supposed to be placed in the dishwasher, or certain shape and/or size of dishware are supposed to be placed at locations on the rack that are designed to fit corresponding size and/or shape of dishes in the dishwasher. In some embodiments, the machine further includes a front door that when closed isolates the mounting rack and the chamber from outside of the machine. In some embodiments, the triggering event includes one or more of opening the front door of the machine; pushing the mounting rack from an extended position back into a retracted position inside the chamber; or detecting a user selection of a machine model from a listing of a plurality of machine models shown on the display in a graphical user interface. In some embodiments, in response to the triggering event, the method further includes initiating the camera on the device and capturing one or more images of the mounting rack. In some embodiments, the camera is initiated when the mounting rack is extended out and/or when the mounting rack is pushed back into the chamber. In some embodiments, the method further includes detecting one or more characteristics of an object based on the one or more images captured by the camera, wherein the one or more characteristics are used for determining a location and an orientation in accordance with the preset constraints to place the object on the mounting rack. In some embodiments, the characteristics of the object include shape, size, materials, orientation, etc. In some embodiments, the object is held by a user prior to placing the object on the mounting rack; or wherein the object is placed at a first location on the mounting rack. In accordance with the detecting one or more characteristics of the object, the method further includes identifying a first location and a first orientation for placing the object on the mounting rack according to the preset constraints; providing, on the display of the device, a notification associated with placing the object on the mounting rack in accordance with the identified first location and the first orientation. In some embodiments, the notification is provided in audio format, on the display, via a visual cue within the chamber of the device that points to the first location for placing the object. In some embodiments, the notification is a recommendation for placing the object at the first location in the first orientation; wherein the notification is an alert associated with a discrepancy between a current location and orientation of the object on the mounting rack and the first location and first orientation according to the preset constraints.

In some embodiments, a method is performed at a device (such as, a dishwasher) having (1) a mounting rack (e.g., extendable—can be extended for loading objects on the rack, and retracted after finishing loading) for holding one or more objects inside a chamber of the device at one or more locations respectively on the mounting rack according to one or more preset constraints and (2) a front door that when closed isolates the mounting rack and the chamber from an outside of the device. The device further includes one or more processors and memory. The method comprises detecting a first action of the front door (e.g., opening the front door); in response to detecting the first action of the front door, initiating a camera installed within the chamber of the device to capture one or more images to monitor/detect a movement of a user's hand within the chamber of the device; after initiating the camera, detecting a movement of a user's hand within the chamber and above the mounting rack of the device based on the captured one or more images; determining, in accordance with the one or more images of the movement of the user's hand captured by the camera, whether the movement of the user's hand corresponds to a moving-in action toward an inside of the chamber of the device (e.g., using a hand-tracking algorithm to analyze the images captured by the camera to determine whether a hand moving-in action by, for example, comparing a sequence of image frames to determine a moving direction of the user's hand); in accordance with a determination that the movement of the user's hand corresponds to a moving-in action toward the inside of the chamber, determining whether the user's hand is holding an object to place the object on the mounting rack within the chamber of the device (e.g., using a hand gesture analysis algorithm to analyze a hand gesture, such as holding an object in the user's hand). The method further includes: in accordance with determining that the user's hand is holding an object, detecting one or more characteristics (e.g., shape, size, material, etc. of the object) of the object based on the one or more images captured by the camera (e.g., using an object detection algorithm); prior to placing the object on the mounting rack, comparing the detected one or more characteristics of the object against the preset constraints for loading one or more objects on the mounting rack; in accordance with a comparison result, determining a first location on the mounting rack and a first orientation associated with placing the object on the mounting rack within the chamber of the device in accordance with the preset constraints (e.g., either an optimized location/orientation or a prohibited location/orientation); and in accordance with a determination result, providing a recommendation of the first location and the first orientation associated with placing the object on the mounting rack within the chamber of the device. In some embodiments, various recommendation formats can used, such as voice output, built-in display (e.g., a screen on the outside surface of the front door), sent to a user's mobile device, displaying a visual cue within the chamber of the device (e.g., shining a laser light towards the first location on the mounting rack).

In some embodiments, a method is performed at a device (such as, a dishwasher or a mobile phone) having (1) a mounting rack for holding one or more objects inside a chamber of the device at one or more locations respectively on the mounting rack according to preset constraints, (2) a front door that when closed isolates the mounting rack and the chamber from an outside of the device, (3) one or more processors, and (4) memory. The method comprises detecting a triggering event associated with an action of a part of the device (e.g., opening of the front door, or pushing the mounting rack from an extended position back in); in response to detecting the triggering event, initiating a camera installed within the device to capture one or more images of a top surface of the mounting rack within the chamber of the device; after initiating the camera, detecting one or more objects placed on the top surface of the mounting rack within the chamber and one or more characteristics of each detected object based on the one or more images captured by the camera (e.g., using an object detection algorithm); comparing the detected one or more characteristics of a respective object of the one or more objects against the preset constraints for loading objects on the mounting rack; in accordance with a comparison result, identifying a discrepancy in loading a first object on the mounting rack within the chamber of the device from the preset constraints; and providing an alert of the discrepancy and a recommendation of an optimized manner associated with loading the first object on the mounting rack within the chamber of the device in accordance with the preset constraints. In some embodiments, the recommendations can be provided in various formats, such as voice output, built-in display (e.g., a screen on the outside surface of the front door), display on a user's mobile device, and/or displaying a visual cue within the chamber of the device (e.g., shining a laser light towards the one or more optimized locations on the mounting rack).

In some embodiments, a method is performed at a mobile device having a camera, one or more output devices (e.g., a display), one or more processors, and memory. The method comprises: displaying, one the display, a listing of a plurality of device models in a graphical user interface, each device model corresponding to a respective device including (1) a mounting rack for holding one or more objects inside a chamber of the respective device at one or more locations respectively on the mounting rack according to a preset constraints and (2) a front door that when closed isolates the mounting rack and the chamber from an outside of the device; receiving a user selection of a first device model from the listing of the plurality of device models displayed in the graphical user interface; capturing, using the camera of the mobile device, an image of one or more objects placed on a top surface of the mounting rack within the chamber of a first device of the selected first device model; determining one or more characteristics of each of the one or more objects included in the image captured by the camera; comparing the detected one or more characteristics of a respective object of the one or more objects against the preset constraints for loading objects on the mounting rack; in accordance with a comparison result, identifying a discrepancy in loading a first object on the mounting rack within the chamber of the device from the preset constraints; providing an alert of the discrepancy and a recommendation of an optimized manner associated with loading the first object on the mounting rack within the chamber of the device in accordance with the preset constraints (e.g., in various recommendation formats, such as audio output on the mobile device and/or the dishwasher, visual output highlighting the optimized location(s) on the mobile device and/or a display of the dishwasher, haptic output such as vibration on mobile phone indicating there is a recommendation for dish placement to be checked on the phone and/or on the display of the dishwasher).

In accordance with some embodiments, a device (e.g., a dishwasher or a mobile phone) includes a camera, one or more output devices, one or more processors, and memory storing instruction, the instructions, when executed by the one or more processors, cause the processors to perform operations of any of the methods described herein. In accordance with some embodiments, a computer-readable storage medium (e.g., a non-transitory computer readable storage medium) is provided, the computer-readable storage medium storing one or more programs for execution by one or more processors of a voice control apparatus, the one or more programs including instructions for performing any of the methods described herein.

Various advantages of the present application are apparent in light of the descriptions below.

BRIEF DESCRIPTION OF THE DRAWINGS

The aforementioned features and advantages of the disclosed technology, as well as additional features and advantages thereof, will be more clearly understood hereinafter as a result of a detailed description of preferred embodiments when taken in conjunction with the drawings.

To describe the technical solutions in the embodiments of the presently disclosed technology or in the prior art more clearly, the following briefly introduces the accompanying drawings required for describing the embodiments or the prior art. Apparently, the accompanying drawings in the following description show merely some embodiments of the presently disclosed technology, and persons of ordinary skill in the art may still derive other drawings from these accompanying drawings without creative efforts.

Like reference numerals refer to corresponding parts throughout the several views of the drawings.

DESCRIPTION OF EMBODIMENTS

Reference will now be made in detail to embodiments, examples of which are illustrated in the accompanying drawings. In the following detailed description, numerous specific details are set forth in order to provide a thorough understanding of the subject matter presented herein. But it will be apparent to one skilled in the art that the subject matter may be practiced without these specific details. In other instances, well-known methods, procedures, components, and circuits have not been described in detail so as not to unnecessarily obscure aspects of the embodiments.

The following clearly and completely describes the technical solutions in the embodiments of the present application with reference to the accompanying drawings in the embodiments of the present application. The described embodiments are merely a part rather than all of the embodiments of the present application. All other embodiments obtained by persons of ordinary skill in the art based on the embodiments of the present application without creative efforts shall fall within the protection scope of the present application.

Figure 1A:
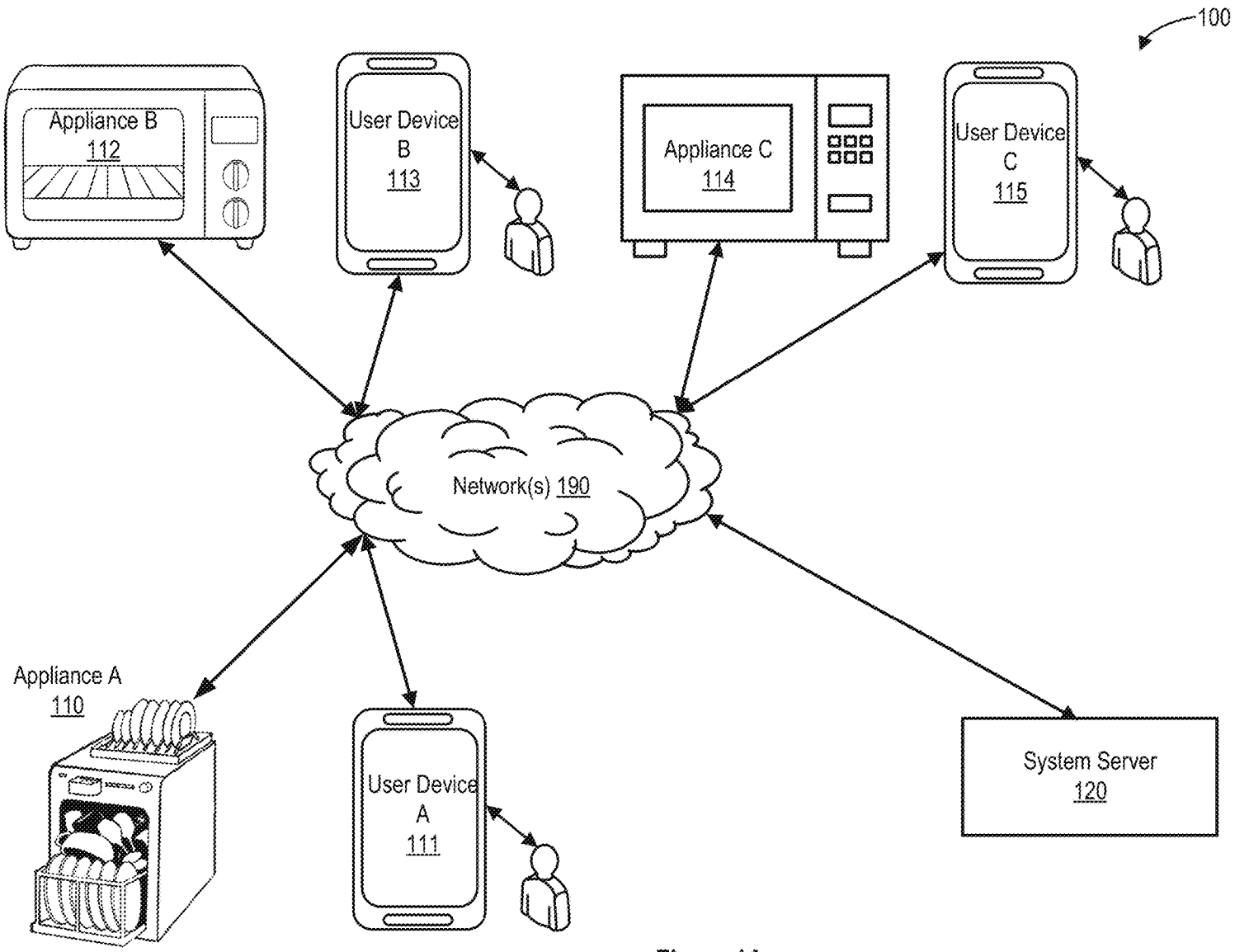
FIG. 1A shows a block diagram of an operating environment of a plurality of home appliances including a dishwasher, in accordance with some embodiments.

FIG. 1A shows a block diagram of an operating environment 100 of a plurality of home appliances, in accordance with some embodiments. In some embodiments, the operating environment 100 includes one or more home appliances (e.g., appliance A—dishwasher 110, appliance B—oven 112, and appliance C—microwave oven 114), connected to one or more servers (e.g., server system 120), and optionally to one or more user devices (e.g., user device A 111, user device B 113, and user device C 115), via network 190 (e.g., a wide area network such as the Internet, or a local area network such as a smart home network).

In some embodiments the one or more home appliances (e.g., smart dishwashers, smart ovens, smart microwave ovens, etc.) are configured to collect raw sensor data (e.g., image, weight, temperature, thermal map data, etc.) and send the raw sensor data to corresponding user devices (e.g., smart phones, tablet devices, etc.), and/or server system 120 (e.g., server provided by the manufacturer of the home appliances or third-party service providers for the manufacturer). In some embodiments, a home appliance is configured to receive control instructions from a control panel of the home appliance, server 120, and/or a corresponding user device. For example, the dishwasher 110 may receive control instructions from user interaction with a control panel and/or one or more buttons installed on the dishwasher for operating the dishwasher. The dishwasher 110 may also receive instructions from server system 120 with regard to optimized placement of dishes within the dishwasher based on images of the rack of the dishwasher. The dishwasher may further receive instructions from user device A 111 to capture one or more images of the dish mounting rack within the dishwasher chamber using the user device A 111. Additional details regarding the one or more home appliances (e.g., appliance A 110, appliance B 112, and appliance C 114) are described in detail with reference to other parts of the present disclosure.

In some embodiments, a respective appliance (e.g., the dishwasher 110) of the one or more home appliances includes an input/output user interface. The input/output user interface optionally includes one or more output devices that enable presentation of media content, including one or more speakers and/or one or more visual displays. The input/output user interface also optionally includes one or more input devices, including user interface components that facilitate user input, such as a keypad, a voice-command input unit or microphone, a touch screen display, a touch-sensitive input pad, a gesture capturing camera, or other input buttons or controls.

In some embodiments, a respective appliance (e.g., the dishwasher 110) of the one or more home appliances further includes sensors, which senses environment information of the respective appliance. Sensors include but are not limited to one or more light sensors, cameras (also referred to as image sensors), humidity sensors, temperature sensors, motion sensors, weight sensors, spectrometers, and other sensors. In some embodiments, one or more devices and/or appliances in the operating environment 100 includes a respective camera and/or a respective motion sensor to detect presence of a user's hand and/or an appearance of an object (e.g., a dishware). In some embodiments, a camera install on the dishwasher 110 is used to capture one or more images associated with the dishwasher 110. For example, the camera is angled to detect motions of a user's hand inside the dishwasher chamber, and/or to monitor or capture images of dishes mounted on a rack inside the dishwasher chamber. In some embodiments, the sensors also provide information on the indoor environment, such as temperature, time of day, lighting, noise level, activity level of the room.

In some embodiments, the one or more user devices are configured to capture images related to dish mounting within the dishwasher chamber, receive raw sensor data from a respective appliance (e.g., user device A 111, which corresponds to appliance A 110, is configured to receive raw sensor data from appliance A 110), perform image analysis to evaluate dish placement within the dishwasher, and/or provide recommendations for optimized dish placement to improve the appliance performance and efficiency. In some embodiments, the one or more user devices are configured to generate and send control instructions to the respective appliance (e.g., user device A 111 may send instructions to appliance A 110 to turn appliance A 110 on/off or to capture one or more images of items placed on a rack of the appliance A 110).

In some embodiments, the one or more user devices include, but is not limited to, a mobile phone, a tablet, or a computer device. In some embodiments, more than one user device may correspond to one appliance (e.g., a computer and a mobile phone may both correspond to appliance A 110 (e.g., both are registered to be a control device for appliance A in an appliance setup process) such that appliance A 110 may send raw sensor data to either or both the computer and the mobile phone). In some embodiments, a user device corresponds to (e.g., shares data with and/or is in communication with) an appliance (e.g., user device A 111 corresponds to appliance A 110). For example, appliance A 110 may collect data (e.g., raw sensor data, such as images or temperature data) and send the collected data to user device A 111 so that the collected data may be annotated by a user on user device A 111.

In some embodiments, system server 120 is configured to receive raw sensor data from the one or more home appliances (e.g. appliances 110, 112, and 114), and/or receive annotated data from the one or more user devices (e.g., user devices 111, 113, and 115). In some embodiments, system server 120 is configured to received one or more images including dish placement on a mounting rack of the dishwasher 110, and/or hand motion associated with dish placement in the dishwasher 110. In some embodiments, system server 120 is configured to receive the captured images associated with the dishwasher 110 from camera(s) mounted on the dishwasher 110 and/or the user device 111. In some embodiments, system server 120 is configured to process the image data, recognize characteristics of the objects (e.g., dishware, cookware, etc.) placed on the mounting rack or held in the user hand to be placed on the mounting rack, and providing placement recommendation based on the processed image information and preset placement constraints of the dishwasher 110.

In some embodiments, home appliances (e.g. appliances 110, 112, and 114), user devices (e.g., user devices 111, 113, and 115), and server system 120 are connected (e.g., sharing data with and/or in communication with) through one or more networks 190. Examples of the communication network(s) 190 include local area networks (LAN) and wide area networks (WAN), e.g., the Internet. The communication network(s) 110 may be implemented using any known network protocol, including various wired or wireless protocols, such as Ethernet, Universal Serial Bus (USB), FIREWIRE, Global System for Mobile Communications (GSM), Enhanced Data GSM Environment (EDGE), code division multiple access (CDMA), time division multiple access (TDMA), Bluetooth, Wi-Fi, voice over Internet Protocol (VoIP), Wi-MAX, or any other suitable communication protocol.

Figure 1B:
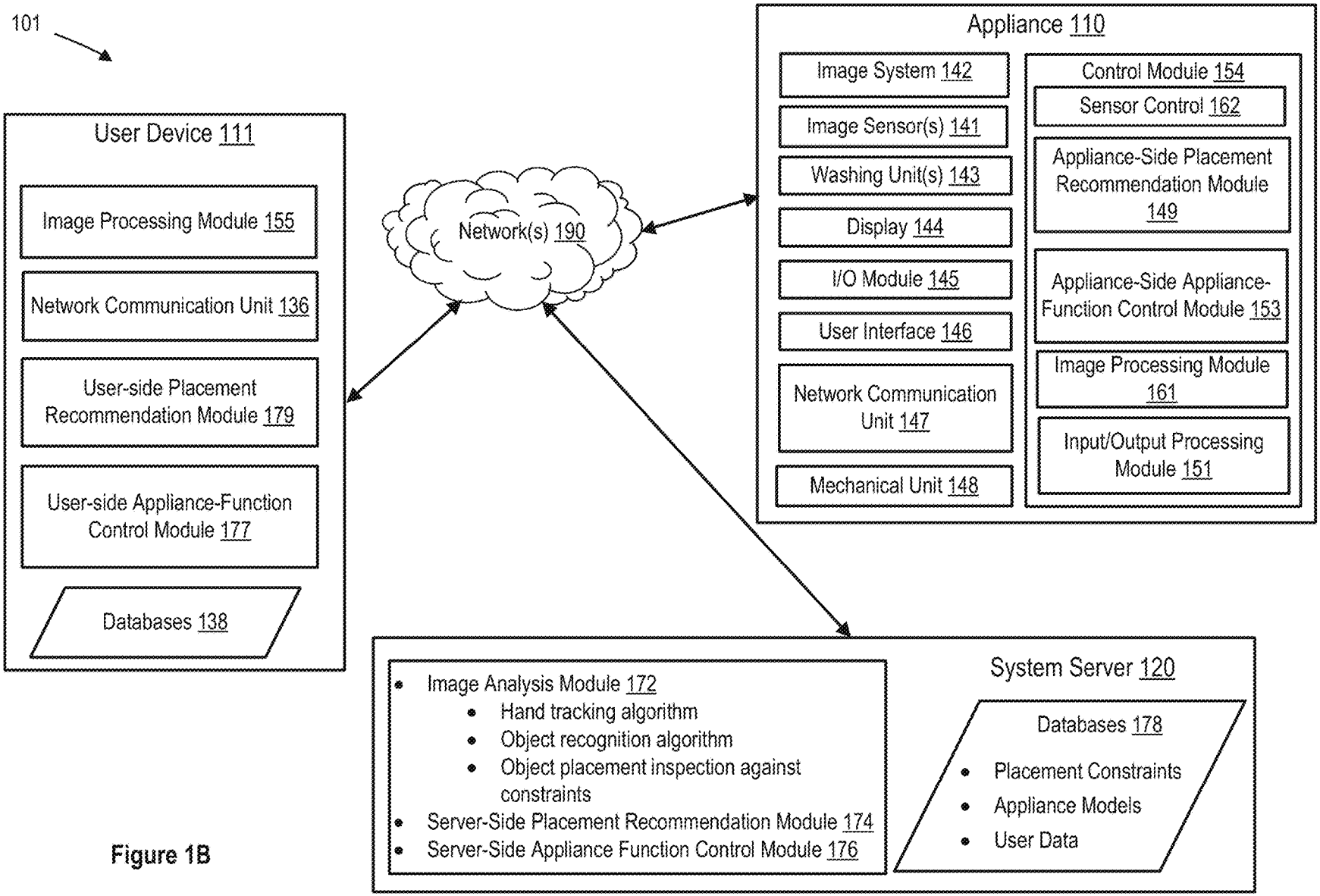
FIG. 1B shows block diagrams of a visual-aided recommendation system for placing objects in a home appliance, in accordance with some embodiments.

FIG. 1B shows block diagrams of a visual-aided recommendation system 101 for objects placement in a home appliance, in accordance with some embodiments. In some embodiments, the visual-aided recommendation system 101 is optionally implemented according to a client-server model. In some embodiments, the visual-aided recommendation system 101 includes the appliance 110 and the user device 111 that operate in a home environment and a server system 120 communicatively coupled with the home environment via cloud networks 190.

Examples of the user device 111 include, but are not limited to, a cellular telephone, a smart phone, a handheld computer, a wearable computing device (e.g., a HMD), a personal digital assistant (PDA), a tablet computer, a laptop computer, a desktop computer, an enhanced general packet radio service (EGPRS) mobile phone, a media player, a navigation device, a game console, a television, a remote control, a point of sale (POS) terminal, an e-book reader, a humanoid robot, or a combination of any two or more of these data processing devices or other data processing devices.

In some embodiments, user device 111 includes one or more of imaging processing module 155, network communication unit 136, and one or more databases 138. In some embodiments, user device 111 further includes user-side placement recommendation module 179 and user-side appliance-function control module 177 to facilitate the visual-aided placement recommendation and appliance control aspects of the system 101 as described herein.

In some embodiments, image processing module 155 obtains images captured by one or more cameras of the user device 111 and/or images captured by imaging system (e.g., image sensors 141, FIG. 1B) of appliance 110 and processes the images for analysis. In some embodiments, the image processing module 155 recognizes one or more characteristics (e.g., shape, size, materials, etc.) of objects (e.g., dishes) detected in the captured images. In some embodiments, the image processing module 155 further detects a mounting rack inside the appliance (e.g., dishwasher) and recognizes the grooves and patterns of the mounting rack for holding one or more objects according to preset constraints. In some embodiments, the image processing module 155 further identifies one or more placement mistakes of the placement of the detected objects in accordance with the preset constraints. The functions of image processing module 155 and imaging system 141 of appliance 110 are further described herein.

In some embodiments, network communication unit 136 allows user device 111 to communicate with appliance 110 and/or system server 120 over one or more networks 190.

In some embodiments, databases 138 include a database of one or more preset constraints for placing objects in the home appliance 110 according to manufacturer settings or user customized settings. For example, the user device 111 may download the preset constraints for placing dishware in a dishwasher of a certain model. In some embodiments, the user may further edit, revise, or add additional constraints according to the user's need (e.g., as discussed with reference to FIGS. 6B-6D) using an application running on the user device 111. In some embodiments, databases 138 may further include data related to one or more characteristics of the objects to be placed in the appliance. In some embodiments, databases 138 further include product information related to one or more models of the appliance 110.

In some embodiments, an application running on user device 111 provides user-side functions, such as user-side placement recommendation and appliance-function control, in conjunction with system server 120 and appliance 110. In some embodiments, the application also provides access to contact the manufacturer or service providers for information and services related to the appliance 110.

In some embodiments, user-side placement recommendation module 149 is configured to provide recommendation for placing objects in the appliance in accordance with characteristics of the objects and preset constraints for placing objects on a rack inside the appliance.

In some embodiments, user-side placement recommendation module 149 is configured to automatically generate placement recommendation locally. In some embodiments, the user-side placement recommendation module 179 sends a request to system server 120, and receive the placement recommendation in real-time from the system server 120. The request includes real-time image data captured by appliance 110 or the user device 111, and the results are determined using characteristics of the objects to be placed on a rack in the appliance and preset constraints for placing objects on the rack that have been determined by manufacturer and/or customized by user.

In some embodiments, user-side appliance-function control module 177 is configured to provide a user interface for the user to directly control the appliance functions (e.g., turning the appliance on/off or setting an appliance parameter, etc.), and/or generate notifications based on the placement recommendation instruction. In some embodiments, placement recommendation is provided to the user-side appliance-function control module 177 from the user-side placement recommendation module 179.

In some embodiments, appliance 110 includes one or more first sensors (e.g., image sensor(s) 141), one or more washing units 143, display 144, I/O module 145, user interface 146, network communication unit 147, mechanical unit 148, control module 155, and, optionally, appliance-side placement recommendation module 149, and appliance-side appliance-function control unit 153. In some embodiments, the one or more devices and/or modules discussed herein are built-in units of the appliance 110. In some embodiments, one or more modules may be implemented on a computing device that is communicatively coupled with the appliance 110 to perform the corresponding functions as discussed herein.

Figure 2B:
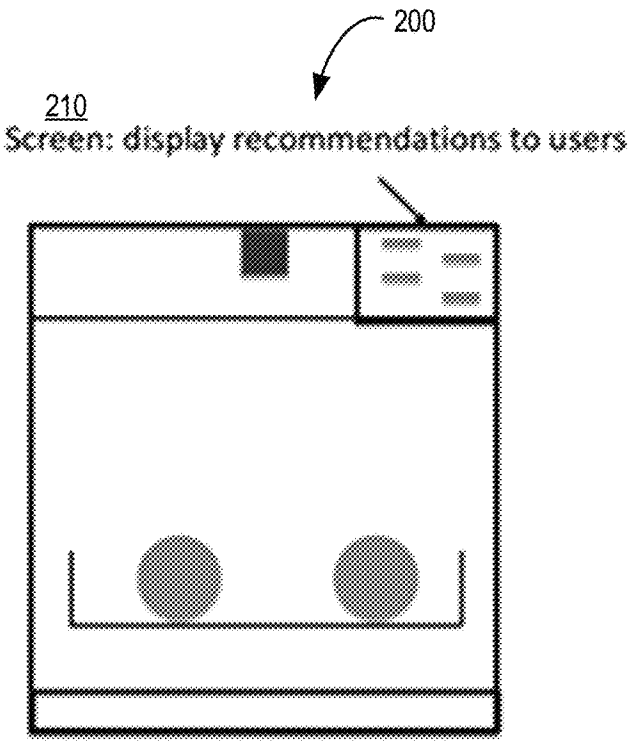
FIGS. 2A-2B are block diagrams showing a placement recommendation system implemented on a dishwasher, in accordance with some embodiments.
Figure 2A:
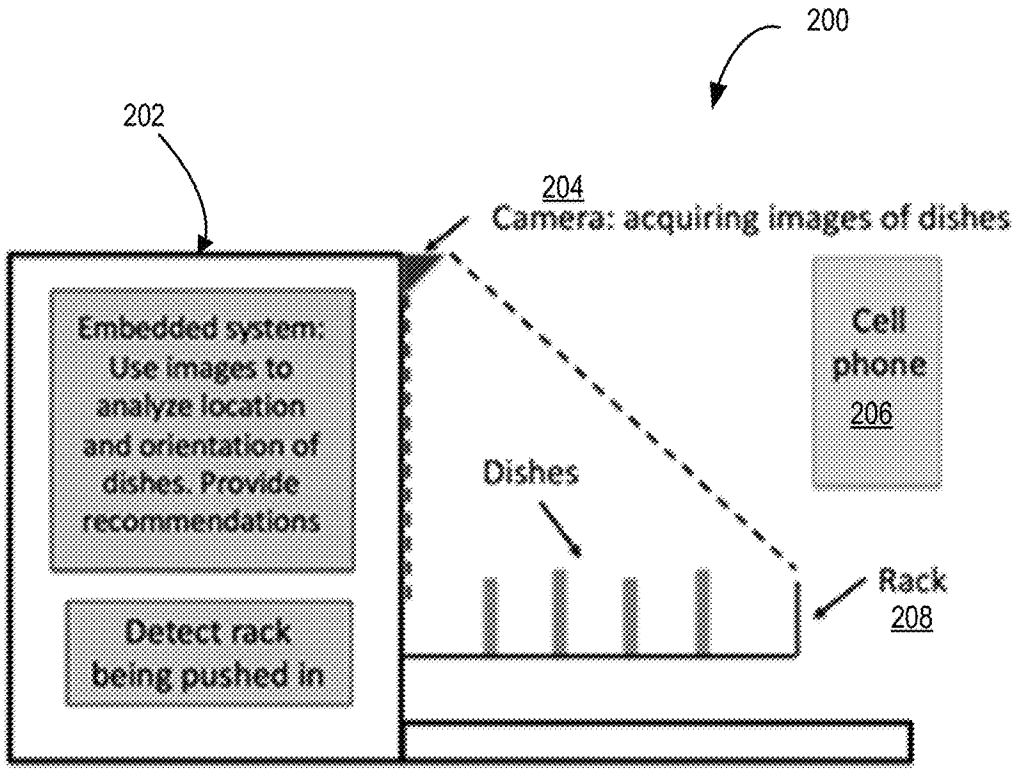

In some embodiments, the image sensors 141 are mounted on the dishwasher and configured to capture images of the space including the rack for mounting dishes inside the dishwasher (e.g., FIG. 2A). In some embodiments, the one or more washing units 143 include water control unit and heat control unit that are configured to wash and dry dishware placed inside the dishwasher. In some embodiments, appliance 140 includes a display 144 that can provide information about appliance 110 to a user (e.g., the washing or drying function of the dishwasher is currently turned on). In some embodiments, display 144 may be integrated with I/O module 145 and user interface 146 to allow the user to input information into or read out information from appliance 110. In some embodiments, display 144 in conjunction with I/O module 145 and user interface 146 provides recommendations, alerts and notification information to the user and receive control instructions from the user (e.g., via hardware and/or software interfaces provided by appliance 110). In some embodiments, display 144 may be a touch screen display or a display that includes buttons. In some embodiments, display 144 may be a simple display with no touch-screen features (such as a conventional LED or LCD display) and user interface 146 may be hardware buttons or knobs that can be manually controlled. In some embodiments, user interface 146 optionally includes one or more of the following a display, a speaker, a keyboard, a touch-screen, a voice input-output interface etc.

Network communication unit 147 is analogous in function to network communication unit 137. Network communication unit 147 allows appliance 110 to communicate with user device 111 and/or system server 120 over one or more networks 190.

Mechanical unit 148 described herein refers to hardware and corresponding software and firmware components of appliance 110 that are configured to physically change the internal sensing (e.g., imaging), heating and/or washing configuration of the dishwasher 110.

In some embodiments, appliance-side placement recommendation module 149 includes functions that are similar to the user-side placement recommendation module 179. For example, the appliance-side placement recommendation module 149 is configured to provide recommendation regarding placement of objects within the dishwasher 110. For example, appliance-side placement recommendation module 149 is configured to, based on image data captured by image sensors 141, determine whether placement of one or more objects on the rack of the dishwasher includes mistakes. In some embodiments, appliance-side placement recommendation module 149 is configured to provide placement recommendation locally. In some embodiments, the appliance-side placement recommendation module 149 sends a request to system server 120, and receive the recommendations in real-time from the system server 120.

In some embodiments, the image sensors 141 are configured to capture unstructured image data. Examples of unstructured data include RGB images and thermal or infrared images. For example, the image sensors 141 may be configured to capture or record still images or videos of object placement on a rack of appliance 110. In some embodiments, imaging system 142 associated with the image sensors 141 includes a data storage system that stores the characteristics of objects to be placed on the rack, dimensions of the grooves and patterns of the rack, the distances between the camera and the rack, such that images taken by the cameras can be used to accurately determine the size and shape of the objects within the images.

In some embodiments, the image capturing is triggered when the image sensors detects that a user's hand holding an object to be placed on the rack enters into the field of view of the camera. In some embodiments, the image capturing is triggered when the dishwasher door is opened, indicating the user may be going to place one or more dishes into the dishwasher. In some embodiments, the image capturing is triggered when the dishwasher (e.g., by a sensor installed on the rack or vis images capture by the image sensors 141) detects that the rack is pushed in, indicating that the user has finished loading the dishes on the rack and is going to start the dishwasher, such that the recommendation system can check whether there needs to perform any adjustment of placement of the dishes on the rack. In some embodiments, the image capturing is triggered manually in response to a user's input, for example, the image capturing is triggered when the appliance 110 receives a user input received on the touch display or a button on the dishwasher 110, or the appliance 110 receives an instruction from the user device 111 which is generated in response to a user's instruction received on the user device 111 (e.g., via the application running on the user device 111) to inspect dish placement on the rack. Manual trigger is easier and less complicated to implement, and allows the user to purposefully capture images according to user's need to receive system recommendation regarding dish placement on the rack. In some embodiments, image processing module 161 obtains the images captured by the one or more image sensors 141, and preprocesses the images to remove the background from the images based on baseline images, e.g., captured before the insertion of dishes on the rack.

In some embodiments, control module 154 includes sensor control 162 configured to control and adjust the image sensors 141. For example, sensor control 162 may send instructions for the image sensors 141 to record videos (e.g., when tracking hand motion) or still images (e.g., after loading dishes capture an image for placement inspection).

In some embodiments, appliance-side appliance-function control module 153 is configured to control and adjust the various functions of appliance 110. For example, appliance-side appliance-function control module 153 may send instructions to washing units 143 to activate a first washing unit of the one or more heating units, or may send instructions to mechanical unit 148. In some embodiments, appliance-side appliance-function control module 153 generates and send control instructions to various components of the appliance 110 based on preconfigured operation protocols (e.g., to implement the normal routine functions of the appliance 110). In some embodiments, appliance-side appliance-function control module 153 generates and send control instructions to various components of the appliance 110 based on real-time dish-loading progress monitored by image sensors 141 within the appliance (e.g., to automatically provide guidance regarding where to place an object or an alert regarding wrong placement of the objects on the rack). In some embodiments, appliance-side appliance-function control module 153 generates and send control instructions to various components of the appliance 110 based on real-time user instructions received from user devices or via user interface 146 of appliance 110.

In some embodiments, the system server 120 is hosted by a manufacturer of the appliance 110. In some embodiments, the system server 120 includes one or more processing modules, such as image analysis module 172, server-side placement recommendation module 174, server-side appliance function control module 176, I/O interface to user device 111, I/O interface to appliance 110, an I/O interface to external services, and data and models stored in databases 178.

In some embodiments, the databases 178 store placement constraints for placing objects with different characteristics on the rack of a dishwasher of a certain model. The placement constraints may be defined by the manufacturer of the dishwasher and/or customized by the user. In some embodiments, the databases 178 further store appliance model information (e.g., dimensions of the mounting rack, distance between camera and the rack, etc.). In some embodiments, the databases further store user data such as information (e.g., dimensions) of user's cookware and dishware, customization of placement constraints, user preference of loading and/or using the dishwasher.

In some embodiments, the system server 120 communicates with external services (e.g., appliance manufacturer service(s), home appliance control service(s), navigation service(s), messaging service(s), information service(s), calendar services, social networking service(s), etc.) through the network(s) 240 for task completion or information acquisition. The I/O interface to the external services facilitates such communications. In some embodiments, the operation information (e.g., operation parameters, preset loading constraints) of the dishwasher is periodically updated at the system server 120 and transmitted to the appliance 110 and/or the user device 111 to store the updated information on the appliance 110 and/or user device 111 respectively. For example, as new shape and/or size of dishes made of new materials are available on the market or become the new trend or become the new household choice of the user, the preset constraints for placing the new dishes on the rack of the dishwasher are revised or updated, and such updated constraints are timely or periodically transmitted to the dishwasher and/or the mobile phone to update the corresponding information. In some embodiments, the image analysis module uses one or more machine learning models that are trained at the system server for hand motion tracking, rack monitoring, and/or object recognition, and the machine learning models are periodically updated at the system server and transmitted to the dishwasher and/or the user's mobile phone to update the corresponding imaging analyzing modules on the dishwasher and/or the mobile device.

In some embodiments, the image analysis module 172 stores hand tracking algorithm to track user's hand motion during an object placement process. The image analysis module 172 may stores object recognition algorithm for recognizing object characteristics, such as shape and size of the dishes to be mounted or already placed on the rack of the dishwasher. The image analysis module 172 may performs object placement inspection against preset constraints for placing objects on the rack of the dishwasher. In some embodiments, the server-side placement recommendation module 174 performs one or more functions similar to those performed by user-side placement recommendation module 179 and/or appliance-side placement recommendation module 149 as discussed herein. In some embodiments, the server-side appliance function control module 176 performs one or more function similar to those performed by user-side appliance-function control module 177 and/or appliance-side appliance function control module 153.

The functions of various systems within placement recommendation system 101 in FIG. 1B are merely illustrative. Other configurations and divisions of the functionalities are possible. Some functions of one sub-system can be implemented on another sub-system in various embodiments. The above examples are provided merely for illustrative purposes. More details of the functions of the various components are set forth below with respect to other figures and illustrations. It can be understood that one or more components described herein may be used independently of other components.

FIGS. 2A-2B are block diagrams showing side and front views respectively of a placement recommendation system implemented on a dishwasher 200, in accordance with some embodiments. In some embodiments, the dishwasher 200 is identical to the appliance 110 as discussed with reference to FIGS. 1A-1B. In some embodiments, the dishwasher 200 includes one or more modules that perform one or more functions as discussed with reference to FIG. 1B. For example as shown in FIG. 2A, the dishwasher 200 includes an embedded system 202 that includes image processing module 161 (e.g., FIG. 1B) for analyzing one or more characteristics (e.g., size, shape, location, and orientation) of the dishes based on the images captured by the camera 204. In some embodiments, the camera 204 is identical to the image sensor(s) 141 discussed in FIG. 1B. In some embodiments, the camera 204 is installed on the top frame of the dishwasher with a field of view including a rack 208 for holding dishes within the dishwasher chamber. In some embodiments, the dishwasher 200 does not have a built-in camera, and the image processing system of the placement recommendation system processes images captured by a user device, such as a user's cell phone 206. In some embodiments, the embedded system 202 further provides placement recommendation based on the analysis results of the captured images. In some embodiments, the dishwasher 200 includes one or more sensors used to detect a triggering event (e.g., when the rack is being pushed back) for initiating the camera on the dishwasher or the user device to start capturing images including the rack of the dishwasher.

In some embodiments, the built-in camera or the camera of the user's device is used to monitor a dish loading process and further verify the dish loading layout on the rack (e.g., either an optimized loading layout prior to loading a certain model of the dishwasher, or a live loading situation during or after the user has placed dishes on the rack). In some embodiments, the placement recommendation system uses hand motion tracking algorithm and/or rack monitoring or tracking algorithm to easily and precisely identify the locations of the dishes on the rack. In some embodiments, for the dishwasher without built-in cameras, the user is required to hold the user device within a certain distance range from the rack and in a certain orientation to take images of the rack, so that the locations of the dishes or the grooves on the rack can be accurately identified in the images captured by the user device. In some embodiments as shown in the front view of the dishwasher 200 in FIG. 2B, the dishwasher further includes a display screen on the outside of the front door of the dishwasher so as to display the placement recommendations generated by the placement recommendation system to the user.

In some embodiments, the placement recommendation system includes hardware such as the built-in camera 204 on the dishwasher 200 or the camera on the user cell phone 206 communicatively coupled to the dishwasher 200 via the cloud-based computing system. In some embodiments, the hardware of the placement recommendation system further includes the display screen as an interface for displaying recommendations regarding dish placement to the user.

In some embodiments, the placement recommendation system includes software including hand detection algorithm for monitoring user's hand motion, objection detection algorithms for detecting dish types, materials, sizes, shapes, and locations on the rack, orientation algorithms for detecting dish orientation related to dish placement on the rack, and recommendation algorithm for identifying optimized locations for placing the detecting objects on the rack according to preset constraints.

Figure 3:
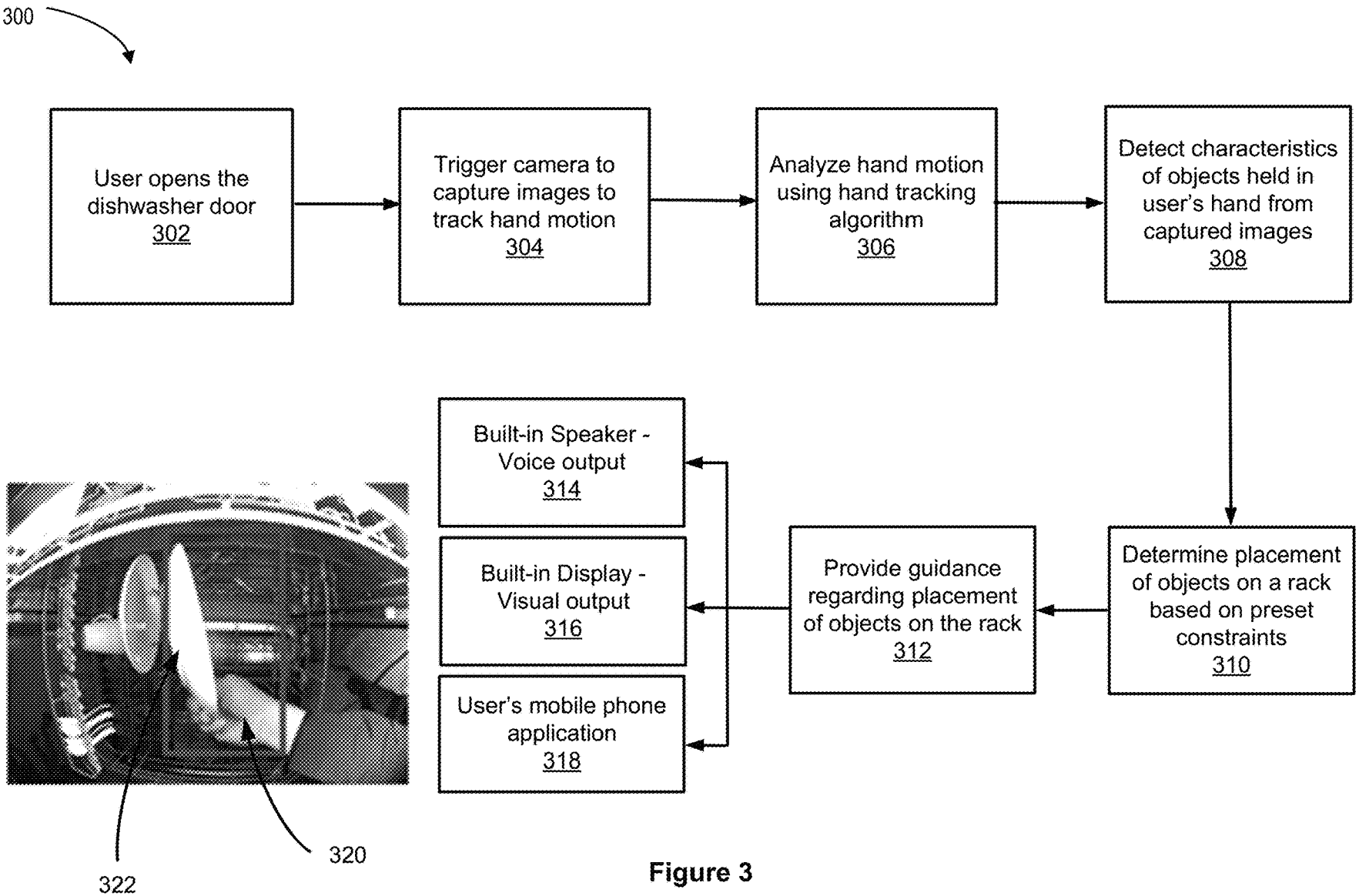
FIG. 3 illustrates a flow diagraph of a process of providing recommendations for loading a dishwasher using a placement recommendation system and a built-in camera on the dishwasher, in accordance with some embodiments.

FIG. 3 illustrates a flow diagraph of a process 300 of providing recommendations for loading a dishwasher using a placement recommendation system and a built-in camera on the dishwasher, in accordance with some embodiments. In some embodiments, one or more sensors installed on the dishwasher detect (302) that the user opens the dishwasher door, indicating that the user may start loading dishes on the rack of the dishwasher. In some embodiments, the detected action (e.g., user opens the door) triggers (304) the camera (e.g., the built-in camera 204, FIG. 2A, the image sensors 141, FIG. 1B) to capture images to track hand motion (e.g., 320) of the user. In some embodiments, the camera takes pictures of its field of view with a frequency of F frames per seconds. In some embodiments, after the camera starts capturing images to track hand motion, the embedded system 202 (FIG. 2A), the appliance-side placement recommendation module 149 (FIG. 1B), or the image processing module 161 (FIG. 1B) analyses (306) hand motion using hand tracking algorithm. In some embodiments, the hand detection algorithm detects all hands in the captured images. In some embodiments, once the hands are detected, the hand tracking algorithm tracks the moving of these detected hands. In some embodiments, only moving-in hands (e.g., the hand that moves toward the inside of the dishwasher chamber) are considered, so as to eliminate the situations where the hand were moving in the dishwasher for purposes other than loading dishes (e.g., unloading dishes after washing).

In some embodiments, when the image processing module or the placement recommendation module finds that the moving-in hand is holding a dish, the placement recommendation system detects (308) characteristics, such as the type, material, size, and shape, of the dish included in the captured images. Based on the detection results, the placement recommendation system determines (310) the optimal rack, optimal location, optimal orientation to load the dish on the rack. In some embodiments, the placement recommendation system further provides (312) guidance or the recommendation of the proper placement of dishes on the rack. In some embodiments, the placement recommendation system provides the guidance or the recommendation in various ways such as voice output (314) via a built-in speaker of the dishwasher, visual output (316) to show text or highlighted map on a built-in display screen, or notifications displayed on a cellphone's app (318).

Figure 4:
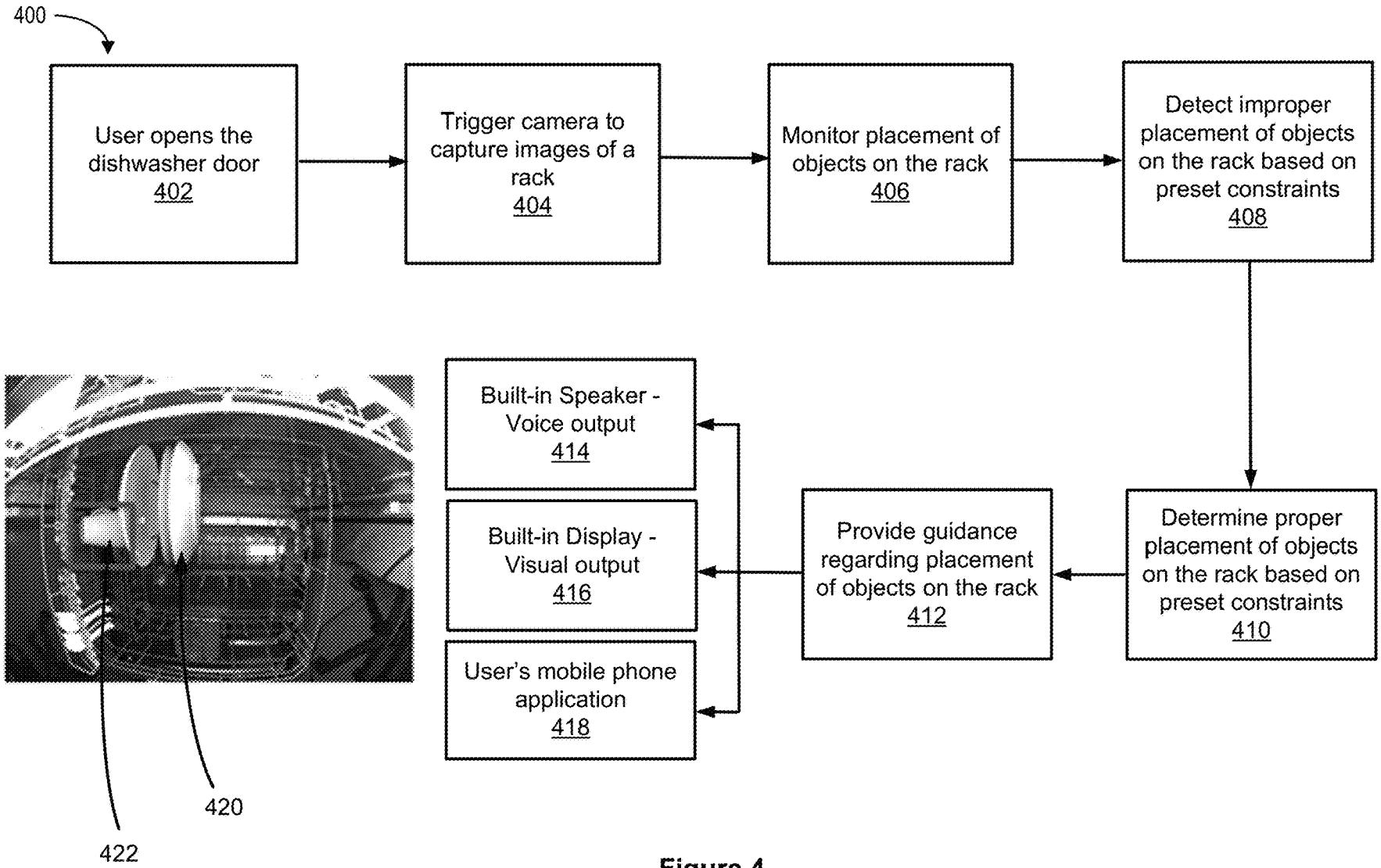
FIG. 4 illustrates a flow diagraph of a process of providing recommendations for loading a dishwasher using a placement recommendation system and a built-in camera on the dishwasher, in accordance with some embodiments.

FIG. 4 illustrates a flow diagraph of a process 400 of providing recommendations for loading a dishwasher using a placement recommendation system and a built-in camera on the dishwasher, in accordance with some embodiments. In some embodiments, one or more sensors installed on the dishwasher detect (402) that the dishwasher door is opened, indicating that the user may start loading dishes on the rack of the dishwasher. In some embodiments, the detected action (e.g., user opens the door) triggers (404) the camera (e.g., the built-in camera 204, FIG. 2A, the image sensors 141, FIG. 1B) to capture images of the rack at a certain frequency of F frames per second to monitor the rack to provide instant recommendations. In some embodiments, the recommendation system uses the camera to monitor (406) placement of dishes on the rack of the dishwasher in the captured images. In some embodiments, the recommendation system detects whether there are misplaced dishes on the rack. In some embodiments, the recommendation system detects that there is an item being placed on the rack (e.g., implemented by detecting differences of the consecutive pictures of the rack), the recommendation system uses the rack monitoring algorithm to recognize the type, material, size, shape, and orientation of the dish. Based on the recognition results, an optimal loading analysis will be kicked in. In some embodiments, the recommendation system detects (408) improper placement of objects on the rack based on preset constraints. For example, if the item is an invalid object (e.g., a non-washable dish 420 made of non-dishwasher safe material) or if the item is a dishware but is improperly loaded (e.g., the cup 422 is mistakenly placed on the bottom rack in the picture included in FIG. 4). In some embodiments, based on the detection result of the improper placement, and based on the characteristics of the dish identified from the capture images, the placement recommendation system determines (410) proper placement of dishes on the rack based on preset constraints (e.g., dishes with certain dimensions and of certain materials are to be placed on certain locations on the rack). In some embodiments, the placement recommendation system provides (412) guidance regarding optimized placement of dishes on the rack. For example, guidance, warnings, and recommendations are provided to the user in various ways such as voice output (414), via a built-in speaker of the dishwasher, visual output (416) to show text or highlighted map on a built-in display screen, or notifications displayed on a cellphone's app (418) text or highlighted map on a built-in display screen, or on a cellphone's app.

Figure 5:
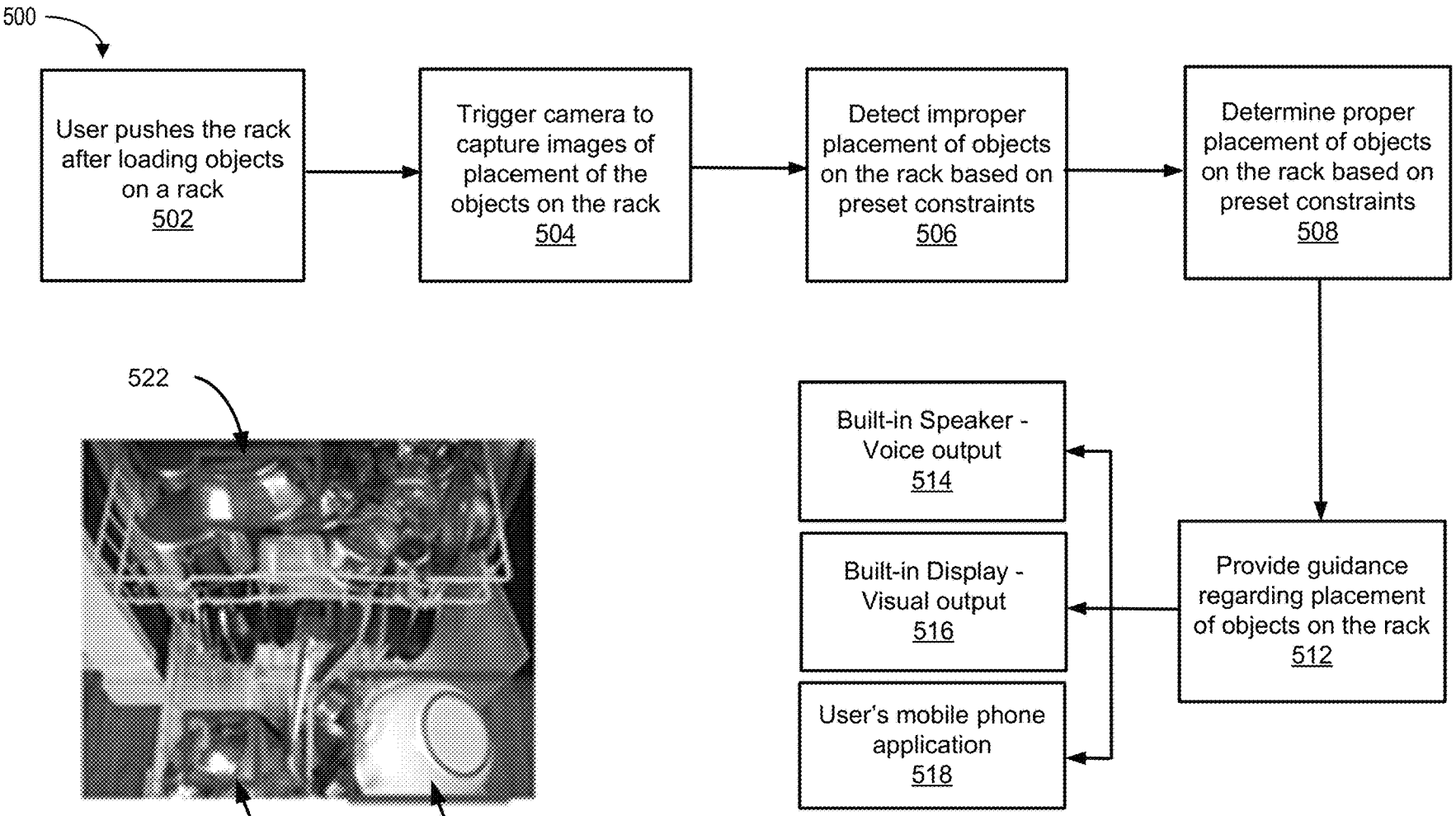
FIG. 5 illustrates a flow diagraph of a process of providing recommendations for loading a dishwasher using a placement recommendation system and a built-in camera on the dishwasher, in accordance with some embodiments.

FIG. 5 illustrates a flow diagraph of a process 500 of providing recommendations for loading a dishwasher using a placement recommendation system and a built-in camera on the dishwasher, in accordance with some embodiments. In some embodiments, one or more sensors installed on the dishwasher detect (502) that the user pushes the rack back into the dishwasher chamber, indicating that the user may complete loading dishes on the rack of the dishwasher. In some embodiments, the detected action (e.g., user pushes the rack in) triggers (504) the camera (e.g., the built-in camera 204, FIG. 2A, the image sensors 141, FIG. 1B) to capture images of placement of the dishes on the rack. In some embodiments, instead of capturing multiple images at a certain frequency, only one or more still images are needed to inspect the loading result on the rack. In some embodiments, the recommendation system detects (506) improper placement of dishes (e.g., dishes 520, 522, and 524 in the photo of FIG. 5) on the rack based on preset constraints. For example, the recommendation system uses the dish detection and recognition. Based on the recognition results, another algorithm (e.g., dish replacement algorithm) analyzes the rack and provides recommendations to the user to adjust the loading. In some embodiments, based on the detection result of the improper placement, and based on the characteristics of the dish identified from the capture images, the placement recommendation system determines (510) proper placement of dishes on the rack based on preset constraints (e.g., dishes with certain dimensions and of certain materials are to be placed on certain locations on the rack). In some embodiments, the placement recommendation system provides (512) recommendation regarding how to correct the improper placement of dishes on the rack. For example, warnings and recommendations to correct improper placement of dishes on the rack are provided to the user in various ways such as voice output (514), via a built-in speaker of the dishwasher, visual output (516) to show text or highlighted map on a built-in display screen, or notifications displayed on a cellphone's application (518) text or highlighted map on a built-in display screen, or on a cellphone's application.

The advantage of using the process 500 in FIG. 5 includes that the recommendation system does not need to continuously monitor either hands (e.g., process 300 in FIG. 3) or racks (e.g., process 400 in FIG. 4), such that the cost and complexity of the recommendation system can be reduced by capturing still images of the post-loading situations. This is useful for cheap systems with low computation configurations. The disadvantage includes that recommendations are provided to the user more slowly than those in process 300 and process 400.

Figure 6A:
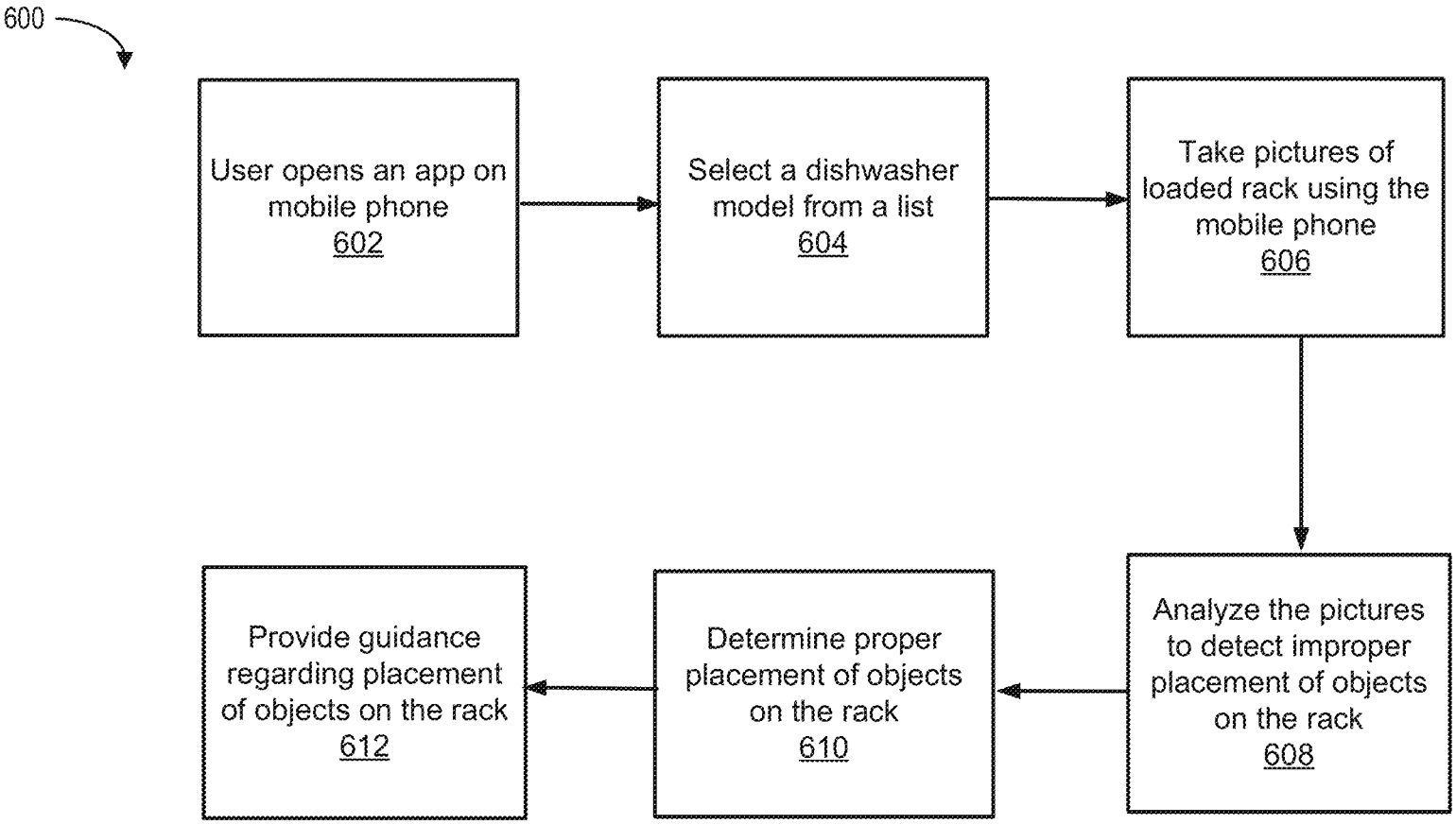
FIG. 6A illustrates a flow diagraph of a process of providing recommendations for loading a dishwasher using a placement recommendation system and a camera of a user device, in accordance with some embodiments.

FIG. 6A illustrates a flow diagraph of a process 600 of providing recommendations for loading a dishwasher using a placement recommendation system and a camera of a user device, in accordance with some embodiments. FIGS. 6B-6E illustrate examples of user interfaces of an application running on the user device for selecting a model of the dishwasher, taking pictures of the dishwasher using the camera of the user device, and inputting customized dish type and parameters to receive customized placement plans, in accordance with some embodiments. In some embodiments, the process 600 is used for dishwashers that do not have the image sensors (camera). In this case, a mobile phone with a camera can be used to capture the placement of dishes on the rack when the user needs a recommendation for dish loading.

Figure 6B:
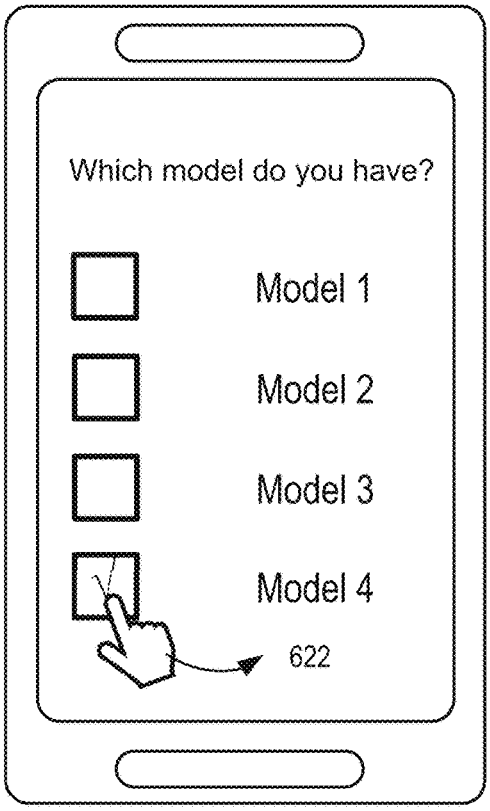
FIGS. 6B-6E illustrate examples of user interfaces for selecting a model of the dishwasher, taking pictures of the dishwasher using the camera of the user device, and inputting customized dish type and parameters to receive customized placement plans, in accordance with some embodiments.
Figure 6C:
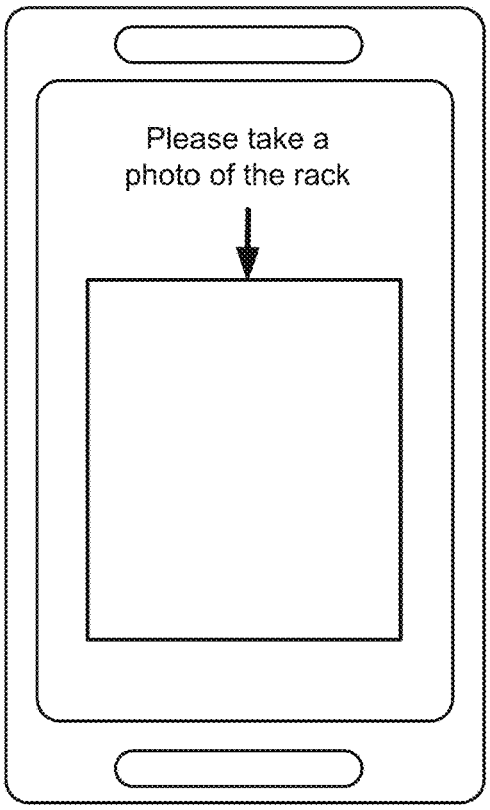
Figure 6D:
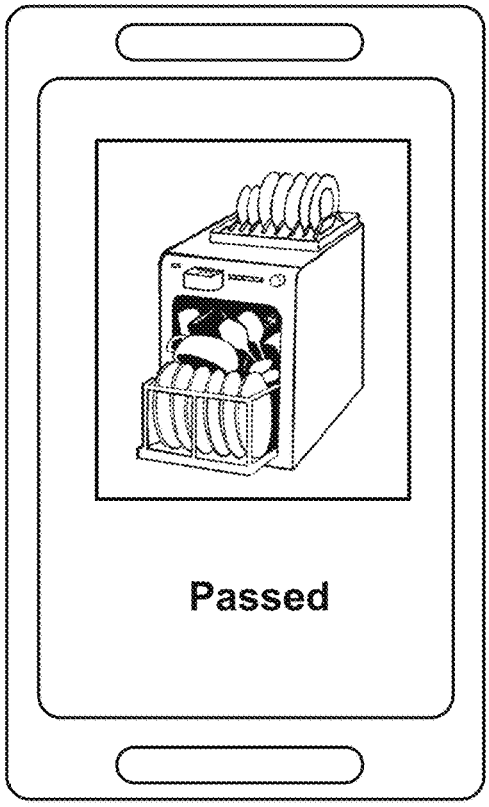

In some embodiments, the user opens (602) an application running on the user's mobile phone. In some embodiments, the application is related to managing or operating the dishwasher. In some embodiments, the user selects (604) his or her dishwasher model from a list of dishwashers provided on the user interface of the app as shown in FIG. 6B. In some embodiments as shown in FIG. 6C, the application may instruct the user to use the camera of the user device to take (606) a picture of the dish he is about to place on the rack and a picture of the rack. In some embodiments as shown in FIG. 6D, the camera takes (606) a picture of the loaded rack with dishes. In some embodiments, the recommendation system uses algorithms in the application to recognize the type, material, shape, and size of the dish. In some embodiments, the system also analyzes (608) the current dish layout in the rack from the captured image to detect improper placement of dishes on the rack. In some embodiments, the placement recommendation system determines (610) proper placement of dishes on the rack based on preset constraints (e.g., dishes with certain dimensions and of certain materials are to be placed on certain locations on the rack). In some embodiments, the placement recommendation system provides (612) guidance or recommendation regarding proper placement of dishes on the rack. In some embodiments, the recommendations can be in voice or in graphic shown by the application on the user device.

Figure 6E:
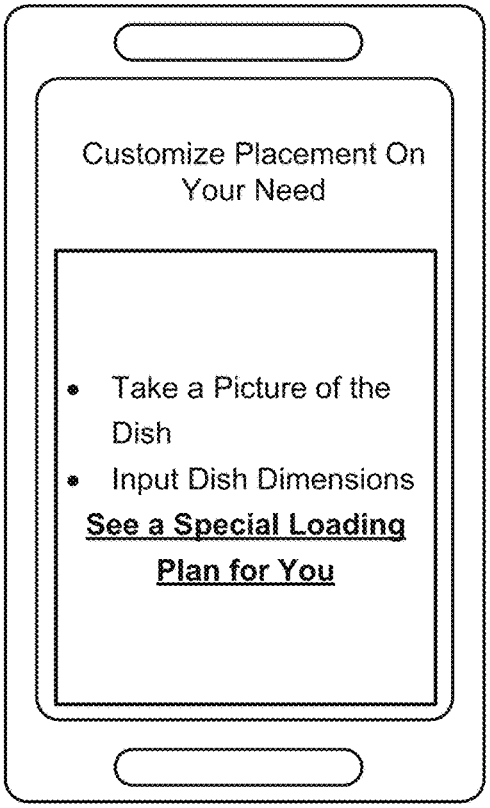

In some embodiments as shown in FIG. 6E, the application can further provide the user the option to provide dimensions of the dishes, and based on the dimension and groove design of the rack of the dishwasher of a certain type, the application can generate customized placement plan for the user according to his or her needs to place his or her special sized or shaped dishes on the rack of the dishwasher. For example, as shown in FIG. 6E, the user may be instructed to take a picture of the dish (e.g., an irregular dish, a dish of a special material, a dish of a special size and/or shape, etc.). In another example, the user may directly input the dimensions of the dish. Then, the recommendation system provides loading plan for the special dish(es) on the rack of the dishwasher.

In some embodiments, for hand detection algorithm, dish detection and recognition algorithm, rack detection algorithms, we can adopt many popular algorithms depending the computation resource. In some embodiments, for the cloud based distributed systems when dishwashers can remotely access clouds, some highly computational algorithms (such as SSD, RetinaNet, MaskRCNN, etc.) can be used. In some embodiments, for the edge-based distributed systems where all the computations happen in edge, some low-cost and light-weight object detection algorithms such as MobileNet, SuffleNet. can be adopted. In some embodiments, for hand tracking module, algorithms such as CAMSHIFT, GOTURN, etc. can be used.

In some embodiments, for dishwashers with built-in camera and have high computation configurations, the processes 300 or 400 can be used. They can provide instant recommendations to the users. In some embodiments, for dish washers with built-in camera but have lower computation configurations, the process 500 can be used. In some embodiments, recommendations are provided only at the last step when the user is done with dish loading and right at the moment he pushes the rack in. In some embodiments, for dishwashers that do not have built-in camera, the process 600 can be used. The process 600 required the user to take pictures of the dish he is about to load and/or the current dish layout in the rack to get recommendations.

The examples discussed in FIGS. 3-5 and 6A-6E are provided for illustrative purposes of the respective embodiments. They can work independently in different processes to provide placement recommendations to the user. In can be understood that one or more embodiments described herein can also be used together in one embodiment of a single process as well. For example, different types of alerts and/or guidance are provided at different stages of dish loading. In another example, dish placement guidance can be provided during dish loading process. In addition, an inspection of dish placement can be performed at the end of dish loading (e.g., triggered by detection of user's action to push the rack into the dishwasher chamber) and prior to running the dishwasher to identify and guide the user to correct any improper dish placement on the rack.

In some embodiments, criteria for triggering the camera to start capturing images of the rack, performing image analysis to guide the dish placement or to inform the user of any improper dish placement, and generating the recommendation alerts may be different depending on the stage of the dish loading and the information available. For example, prior to placing any dishes on the rack, the image capturing by the camera may be triggered by detection of the opening of the dishwasher door (e.g., as discussed with reference to FIG. 3), and a hand motion tracking algorithm is used to track hand motion, recognize characteristics of a dish held on the user's hand, performing analysis to identify one or more optimized locations to place the dish, and provide visual or audio guidance to the user to place the use on the rack. In another example, during dish loading process, the image capturing may be triggered by detecting that the dishwasher door is opened (e.g., as discussed with reference to FIG. 4), and a rack monitoring algorithm is used to monitor the dishes placed on the rack, and provide notifications to the user when the system detects any improper dish placement on the rack. In yet another example, after the user finishes loading the dishes on the rack and in response to detecting that the user pushes the rack back in (e.g., as discussed with reference to FIG. 5), the camera takes one or more still images and the system performs image analysis on the captured images to identify any incorrect or unoptimized dish placement on the rack to inform the user via visual display and/or audio alert. It is to understood that one or more of these embodiments can also be used together at different stage of loading dishes into the dishwasher.

Further, the embodiment discussed in FIGS. 6A-6E can be used separately or together with other embodiments as the user may use the application running on the user's mobile phone to check dish loading result in addition to receiving notifications from the dishwasher. For example, the user may use the camera on the mobile phone to check dish loading on a portion of the rack (e.g., top rack, bottom rack, inner left corner of the top rack, etc.), as sometimes the user may need guidance or recommendations regarding how to load an irregular piece of the cookware or dishware on the rack of the dishwasher.

Figure 7:
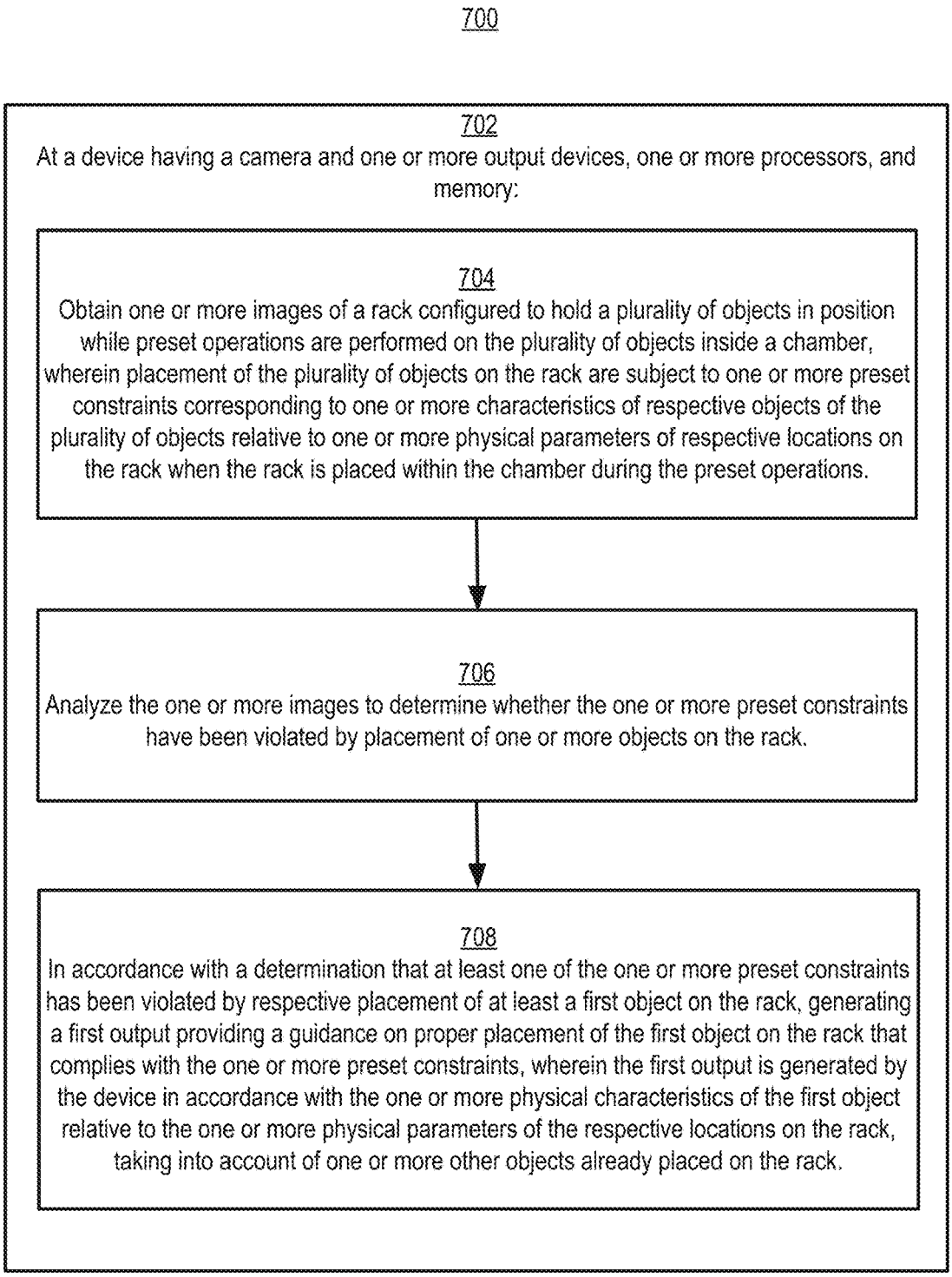
FIG. 7 is a flowchart diagram of a method for providing recommendations for placing objects in a dishwasher, in accordance with some embodiments.

FIG. 7 is a flowchart diagram of a method 700 for providing recommendations for placing objects in a dishwasher, in accordance with some embodiments. In some embodiments, the method 700 is performed at (702) a device, such as a dishwasher (e.g., appliance 110 of FIGS. 1A-1B or dishwasher 200 of FIGS. 2A-2B) or a mobile phone (e.g., user device 111 of FIGS. 1A-1B). In some embodiments, the device has a camera, one or more output devices, one or more processors, and memory. In some embodiments, the one or more output devices of the device include a display, a touch-screen, a speaker, an audio output generator, a tactile output generator, a signal light, and/or a projector.

In some embodiments, the method 700 includes obtaining (704) one or more images of a rack (e.g., a dish rack, or dish drawer) configured to hold a plurality of objects in position while preset operations (e.g., washing, scrubbing, rinsing, drying, disinfecting) are performed on the plurality of objects inside a chamber (e.g., a dishwasher chamber). In some embodiments, the plurality of objects include dishes, bowls, pots, pans, different kinds of utensils, wooden spoons, cups, glasses, water bottles, silicone molds, plastic containers, bakeware, knives, glass lids, aluminum pans. Although dish or dishware is use throughout the disclosure, it is to be understood that the objects to be loaded or being loaded in the dishwasher can include any type of objects as listed above. In some embodiments, placement of the plurality of objects on the rack are subject to one or more preset constraints corresponding to one or more characteristics (e.g., shape, size, orientation, materials, etc.) of respective objects of the plurality of objects relative to one or more physical parameters of respective locations on the rack. In some embodiments, such placement takes into consideration spatial configurations, such as dimensions and/or shapes of the rows, layers, wires, tines, baskets, and/or clips on the rack, when the rack is placed within the chamber during the preset operations. In some embodiments, some locations that appear to hold the dishes fine when the rack is outside will not work because they may not be accessible by sprayed water, or may block a spray arm from swinging, may block other objects from being sprayed and cleaned, or may be blocked by other parts of the dishwasher chamber once the rack is inserted or in the process of bring inserted into position in the dishwasher chamber, or the height of the dishes may not fit once the rack is placed inside the dishwasher chamber.

In some embodiments, the method 700 includes analyzing (706) the one or more images to determine whether the one or more preset constraints have been violated by placement of one or more objects on the rack. For example, the one or more images may be analyzed using one or more algorithms, such as hand motion tracking algorithm, rack monitoring algorithm, object recognition algorithm, as discussed herein.

In some embodiments, the method 700 includes generating (708) a first output providing a guidance on proper placement of the first object on the rack that complies with the one or more preset constraints, in accordance with a determination that at least one of the one or more preset constraints has been violated by respective placement of at least a first object on the rack. In some embodiments, this violation can be detected during placement of the first object or after placement of all objects. In some embodiments, the first output is generated by the device in accordance with the one or more physical characteristics of the first object relative to the one or more physical parameters of the respective locations on the rack, taking into account of one or more other objects already placed on the rack. In some embodiments, the first output is generated depending on the quantity, locations, and physical characteristics of other objects already loaded onto the rack at the time that the first object is being loaded onto the rack. For example, certain locations on the rack may be blocked (e.g., blocked by other objects already loaded, objects that are later loaded, and/or internal parts of the chamber), unavailable (e.g., occupied by other objects that are already loaded, objects that are later loaded, or internal parts of the chamber (e.g., sprayer arm, soap dispenser, etc.)), unsuitable for the first object (e.g., unsuitable temperature at the bottom rack for the first object) once the rack is pushed into the dish washer chamber).

In some embodiments, the rack is part of a dishwasher that performs preset dish washing operations on the plurality of objects when the rack is inserted into the dishwasher. In some embodiments, the one or more preset constraints include a first constraint imposed by a position of a sprayer of the dishwasher, such as a fixed sprayer, or a moveable sprayer (e.g., with lateral movement or rotational movement during performance the preset operations) inside the chamber.

In some embodiments, the one or more preset constraints include a second constraint imposed by temperature distribution within the chamber during performance of the preset operations. For example, upper portion of the chamber (e.g., a top rack) has lower temperatures and are suitable for plastic objects, and lower portion of the chamber (e.g., a bottom rack) has higher temperatures and are suitable for metal, glass, and ceramic objects.

In some embodiments, the one or more preset constraints include a third constraint imposed by presence of an earlier loaded object that faces a first direction relative to a preset portion of the rack. For example, the earlier loaded object (e.g., a dish) faces toward the center of the rack, and the third constraint requires an adjacent object to also face the same direction as the earlier loaded object.

In some embodiments, the one or more preset constraints include a fourth constraint that prevents a concave surface of a respective object to face upward in the chamber. For example, a dish or bowl should not be faced upward during dish washing.

In some embodiments, the device is a dishwasher (e.g., the appliance 110 of FIGS. 1A-1B, dishwasher 200 of FIGS. 2A-2B) that includes the camera. In some embodiments, the dishwasher includes a touch-screen (e.g., screen 210, FIG. 2B) that displays prompt information regarding a loading error or a loading recommendation while an object is being loaded onto the dish rack, after multiple objects have been loaded (e.g., the rack is full), and/or after the user has finished loading (e.g., the user tries to push the rack into the chamber). In some embodiments, the device includes a signal that visually highlights a recommended location and/or orientation for the object that is found to have violated the one or more constraints. For example, a laser light pointer on the dishwasher (e.g., next to the camera) projects a light spot or sign (e.g., still arrow or animated arrow) onto the offending object and/or the recommended location to indicate where the user should move the object and/or how the user should orient the object at the proper location. In some embodiments, audio outputs (e.g., speech, alerts) are generated to prompt the user to move the currently loaded object. In some embodiments, visual guides, such as height limits and prohibited regions are visually marked by laser beams, are placed in the space on or above the rack.

In some embodiments, the device is a mobile device (e.g., user device 111 of FIGS. 1A-1B, cell phone 206 of FIG. 2A) that has a user interface for selecting a model identifier corresponding to the rack. In some embodiments, the device retrieves at least some of the one or more preset constraints in accordance with a first model identifier selected by a user via the user interface. In some embodiments, the device can further receive updates from the system server 120 regarding updates to the one or more preset constraints. In some embodiments, the user interface of the device can also be used by the user to customize one or more constraints for placing one or more dishes (e.g., of irregular shape or unusual size). As discussed in FIG. 6E, the user can take a picture of the dish or directly input dimensions or other characteristics of the dish, and the system can automatically generate one or more recommendations for placing such dish on the rack of the dishwasher.

In some embodiments, obtaining the one or more images of the rack configured to hold a plurality of objects in position while preset operations are performed on the plurality of objects inside a chamber is performed in response to detecting opening of the chamber. For example, the images are obtained in response to detecting opening of a front door of the dishwasher (e.g., FIGS. 3-4). In another example, the images are obtained in response to detecting pulling out of the rack from inside the chamber (e.g., FIG. 5). For example, the device (e.g., dishwasher) includes a actuation sensor attached to the door of the device or the rack of the device, and movement of the door or the rack generates a trigger event that triggers the camera attached to the front of the device (e.g., behind the door on the door frame of the dishwasher) to capture a sequence of one or more images.

In some embodiments, obtaining the one or more images of the rack configured to hold a plurality of objects in position while preset operations are performed on the plurality of objects inside a chamber is performed in response to detecting movement of an object toward the rack after the chamber is opened. In some embodiments, the images are obtained in response to detecting a hand moving toward the rack, and the hand motion is further tracked. Then, the method further includes identifying the object held by the hand as the hand is moving toward the rack. For example, the device (e.g., dishwasher) includes a actuation sensor attached to the door of the device or the rack of the device, and movement of the door or the rack generates a trigger event that triggers the camera attached to the front of the device (e.g., behind the door on the door frame of the dishwasher) to capture a video, and each time an new object is being brought toward the rack, the device starts a new analysis for the currently held object based on a segment of the video corresponding to the loading of the current object.

In some embodiments, obtaining the one or more images of the rack configured to hold a plurality of objects in position while preset operations are performed on the plurality of objects inside a chamber is performed in response to detecting movement of the rack into the chamber. For example, the device (e.g., dishwasher) includes a actuation sensor attached to the door of the device or the rack of the device, and movement of the rack into the chamber of the device generates a trigger event that triggers the camera attached to the front of the device (e.g., behind the door on the door frame of the dishwasher) to capture one or more images that show the rack after the loading of all objects.

In some embodiments, obtaining the one or more images of the rack is performed during loading of a respective object onto the rack and after completion of loading for a respective object load. For example, placement of each object is assessed during the loading of that object, and location/placement recommendation is provided for the object; and after placement of all objects for a load, alerts are provided if it is determined that a respective object violates the preset constraints in light of other objects placed in the rack at the completion of the loading.

In some embodiments, different sets of criteria are used for generating the first output depending on whether the violation is found during loading of the respective object or after the completion of the loading. For example, during loading of a respective object, more stringent criteria are used to determine whether the one or more constraints are violated (e.g., proper loading is defined by optimal or recommended loading practice guidelines), and recommendations are provided if the predicted loading location/orientation (e.g., based on the direction of movement of the hand, and how the object is being held) or initial location/orientation of the object are less than optimal based on the currently loaded objects and their distributions in the rack. After the completion of loading, all the objects are loaded into the rack, and a less stringent set of requirements are used to determine if the objects were loaded properly. For example, the loading is considered proper as long as the dishwasher will function properly, e.g., sprayer will reach all regions (e.g., maybe not with all equal efficiency), detergent dispenser door will open, and sprayer will not blocked during operation.

In some embodiments, the first output includes a first component that provides a recommendation or error correction instruction for the proper placement of the first object on the rack, and an explanation for the recommendation or error correction instruction. For example, the error or recommendation for a specific object is used as an example for a teaching moment to educate the user about how a dishwasher should be loaded, so that the user can do better next time when other similar objects are being loaded into the dish washer.

In some embodiments, analyzing the one or more images to determine whether the one or more preset constraints have been violated by placement of one or more objects on the rack include optimizing one or more performance parameters (e.g., optimal distribution of detergent, water, and temperature, cleansing efficiency, energy efficiency, water efficiency, etc.) associated with the preset operations by adjusting a location and orientation of a respective object on the rack and checking against one or more fixed rules regarding a location and orientation of the respective object on the rack. For example, the dishes can't block sprayer, while must be accessible by water and detergent for adequate cleaning and rinsing. In another example, the dishes must allow proper drainage of water, must allow opening of detergent dispenser, must allow proper closing of the door, and stability of the whole machine.

In some embodiments, the method 700 further includes obtaining an image of all objects that are to be loaded onto the rack from a mobile device prior to obtaining the one or more images. For example, the user takes a photo of all dishes that need to be loaded into the dishwasher using a mobile phone, and transmits the photo to the dishwasher before she starts loading the dishwasher. In some embodiments, the first output is generated by the device further in accordance analysis taking into account other objects among all the objects that are to be loaded onto the rack but that have not already placed on the rack.

In some embodiments, although the camera on the dishwasher and/or on the mobile phone is triggered to start capturing images in response to one or more triggering events (e.g., the user opens the dishwasher door, the user pushes the rack back into the dishwasher chamber, etc.), the placement recommendation system is automatically started to analyze the captured images, identify improper dish placement, identify optimized location(s) for placing the dish(es), and provide the guidance or recommendation to the user via one or more output formats as discussed herein. That is, the user may not need to use additional user input to instruct the placement recommendation system to analyze the The recommendation processes as discussed herein may not need any direct interaction between the user's hand and the dishwasher or the mobile phone (e.g., the camera is triggered by certain triggering events, and the recommendation analysis is automatically started following capturing the one or more images). This is convenient when the user's hands are occupied or inconvenient to interact with the dishwasher or the mobile phone, for example, when the user is holding a dish in his or her hand, or when the user has greasy hands from cooking, the user may not want to touch the dishwasher or the mobile phone. The recommendation system can automatically start the analysis and recommendation processes following the camera capturing the images without requiring any additional user input. In some embodiments, the camera capturing functions and/or the initiation of the recommendation processes may also controlled by user's voice input, thus freeing the user's busy hands occupied from errands in the kitchen.

Figure 8:
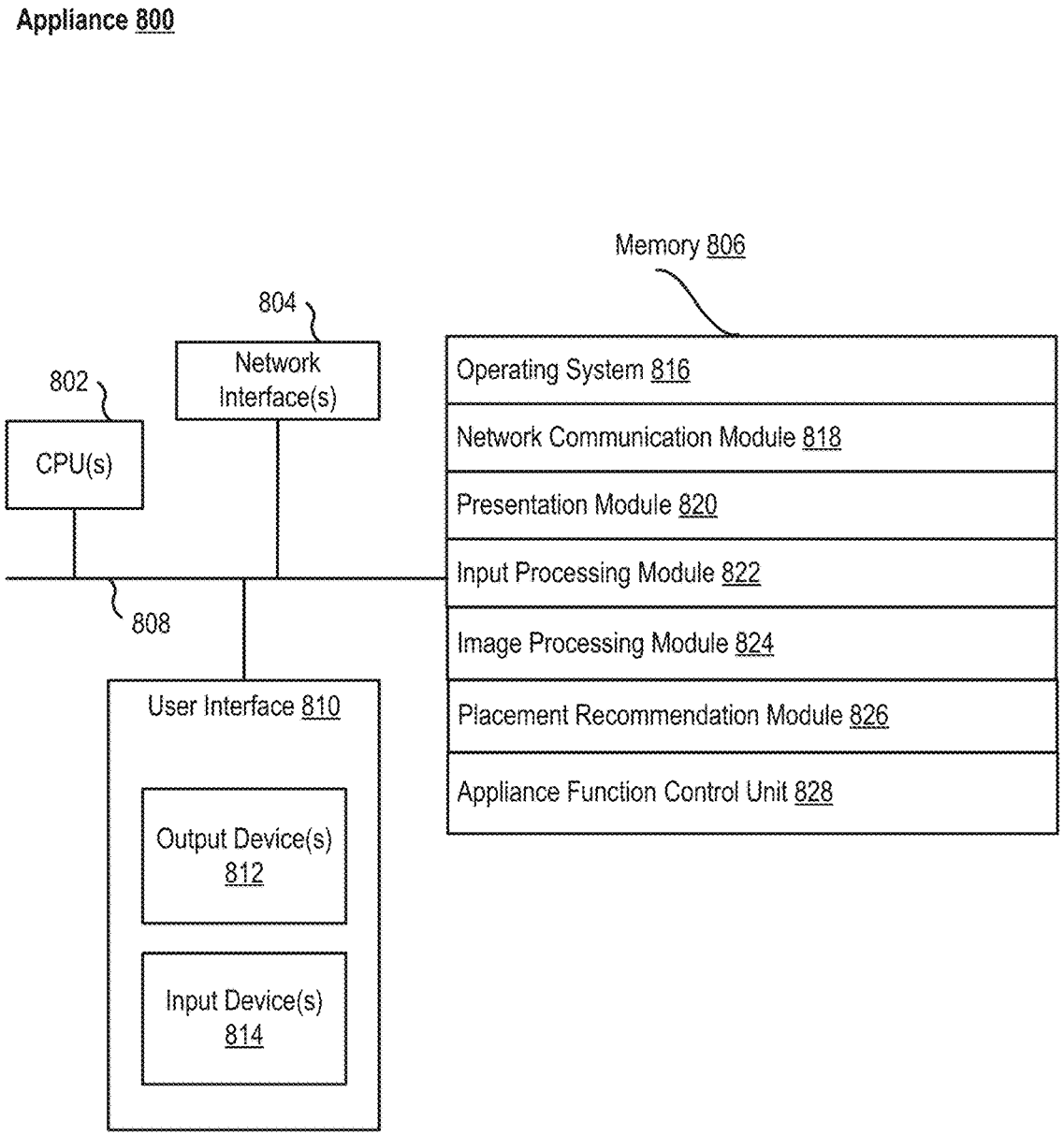
FIG. 8 is a block diagram illustrating an appliance with a placement recommendation system, in accordance with some embodiments.

FIG. 8 is a block diagram of an exemplary appliance 800 (e.g., appliance 110, or dishwasher 200) in accordance with some embodiments. The appliance 800 includes one or more processing units (CPUs) 802, one or more network interfaces 804, memory 806, and one or more communication buses 808 for interconnecting these components (sometimes called a chipset). The appliance 800 also includes a user interface 810. User interface 810 includes one or more output devices 812 (e.g., touch screen 210) that enable presentation of media content, including one or more speakers and/or one or more visual displays. User interface 810 also includes one or more input devices 814, including user interface components that facilitate user input such as a keyboard, a mouse, a voice-command input unit or microphone, a touch screen display (e.g., touch screen 210), a touch-sensitive input pad, a gesture capturing camera, or other input buttons or controls. In some embodiments, appliance 800 further includes sensors (e.g., image sensors 141), which capture images of the appliance 800. Sensors include but are not limited to one or more heat sensors, light sensors, one or more cameras, humidity sensors, one or more motion sensors, one or more biological sensors (e.g., a galvanic skin resistance sensor, a pulse oximeter, and the like), weight sensors, spectrometers, and other sensors.

Memory 806 includes non-volatile memory, such as one or more magnetic disk storage devices, one or more optical disk storage devices, one or more flash memory devices, or one or more other non-volatile solid state storage devices. Memory 806, optionally, includes one or more storage devices remotely located from one or more processing units 802. Memory 806, or alternatively the non-volatile memory within memory 806, includes a non-transitory computer readable storage medium. In some implementations, memory 806, or the non-transitory computer readable storage medium of memory 806, stores the following programs, modules, and data structures, or a subset or superset thereof:

- operating system 816 including procedures for handling various basic system services and for performing hardware dependent tasks;
- network communication module 818 for connecting to external services via one or more network interfaces 804 (wired or wireless);
- presentation module 820 for enabling presentation of information;
- input processing module 822 for detecting one or more user inputs or interactions from one of the one or more input devices 814 and interpreting the detected input or interaction, such as detecting triggering events (e.g., opening the dishwasher door or pushing in the rack of the dishwasher);
- image processing module 824 (e.g., image processing module 161, FIG. 1B) for analyzing the capture images to identify characteristics of the objects (e.g., dishes), rack layout, and/or hand motion;
- placement recommendation module 826 (e.g., appliance-side placement recommendation module 149, FIG. 1B) for providing guidance and/or recommendation regarding how to place dishes on the rack in accordance with characteristics of the dishes, rack layout, and one or more preset constraints as discussed herein; and
- appliance function control unit 828 (e.g., appliance-side appliance-function control module 153) for controlling various operations of the appliance 800, such as washing, heating, sanitizing, and/or drying of the dishwasher.

Figure 9:
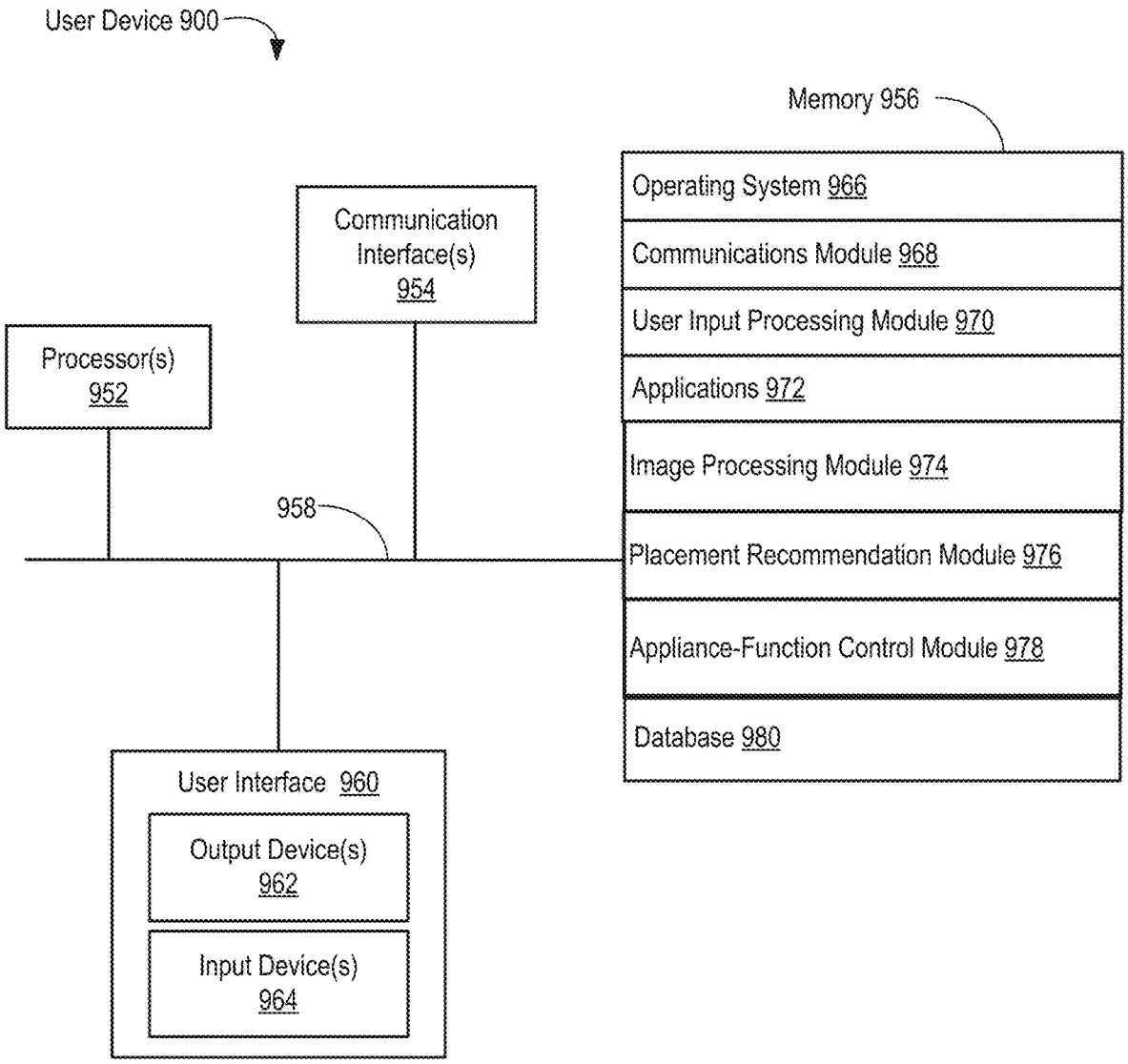
FIG. 9 is a block diagram illustrating a user device that works in junction with an appliance in a placement recommendation system, in accordance with some embodiments.

FIG. 9 is a block diagram illustrating a user device 900 (e.g., user device 111 of FIGS. 1A-1B, cell phone 206 of FIG. 2A) in accordance with some embodiments. User device 900, typically, includes one or more processing units (CPUs) 952 (e.g., processors), one or more network interfaces 954, memory 956, and one or more communication buses 958 for interconnecting these components (sometimes called a chipset). User device 900 also includes a user interface 960. User interface 960 includes one or more output devices 962 that enable presentation of media content, including one or more speakers and/or one or more visual displays. User interface 960 also includes one or more input devices 964, including user interface components that facilitate user input such as a keyboard, a mouse, a voice-command input unit or microphone, a touch screen display, a touch-sensitive input pad, a gesture capturing camera, one or more cameras, depth camera, or other input buttons or controls. Furthermore, some user devices 900 use a microphone and voice recognition or a camera and gesture recognition to supplement or replace the keyboard. In some embodiments, user device 900 further includes sensors, which provide context information as to the current state of user device 900 or the environmental conditions associated with user device 900. Sensors include but are not limited to one or more microphones, one or more cameras (e.g., used to capture images of the dishwasher chamber in response to receiving user input from the user interface of the application running on the user device 900), an ambient light sensor, one or more accelerometers, one or more gyroscopes, a GPS positioning system, a Bluetooth or BLE system, a temperature sensor, one or more motion sensors, one or more biological sensors (e.g., a galvanic skin resistance sensor, a pulse oximeter, and the like), and other sensors.

Memory 956 includes high-speed random access memory, such as DRAM, SRAM, DDR RAM, or other random access solid-state memory devices; and, optionally, includes non-volatile memory, such as one or more magnetic disk storage devices, one or more optical disk storage devices, one or more flash memory devices, or one or more other non-volatile solid-state storage devices. Memory 956, optionally, includes one or more storage devices remotely located from one or more processing units 952. Memory 956, or alternatively the non-volatile memory within memory 956, includes a non-transitory computer readable storage medium. In some implementations, memory 956, or the non-transitory computer readable storage medium of memory 956, stores the following programs, modules, and data structures, or a subset or superset thereof:

- operating system 966 including procedures for handling various basic system services and for performing hardware dependent tasks;
- communication module 968 for connecting user device 900 to other computing devices (e.g., server system 120) connected to one or more networks 190 via one or more network interfaces 954 (wired or wireless);
- user input processing module 970 for detecting one or more user inputs or interactions from one of the one or more input devices 964 and interpreting the detected input or interaction;
- one or more applications 972 for execution by user device 900 (e.g., appliance manufacturer hosted application for managing and controlling the appliance as shown in FIGS. 6B-6E, payment platforms, media player, and/or other web or non-web based applications);
- image processing module 974 (e.g., image processing module 155, FIG. 1B) for analyzing the capture images to identify characteristics of the objects (e.g., dishes), rack layout, and/or hand motion;
- placement recommendation module 976 (e.g., user-side placement recommendation module 179, FIG. 1B) for providing guidance and/or recommendation regarding how to place dishes on the rack in accordance with characteristics of the dishes, rack layout, and one or more preset constraints as discussed herein; and
- appliance function control unit 978 (e.g., user-side appliance-function control module 177, FIG. 1B) for controlling various operations of the appliance 110, such as washing, heating, sanitizing, and/or drying of the dishwasher, via an application running on the user device 900.
- database 990 (e.g., database 130, FIG. 1B) for storing various data, models, and algorithms as discussed herein, which include but not limited to user data (e.g., dishwasher using preferences, dish loading preferences, user customized loading constraints, appliance model and machine data associated with the appliance(s) owned and registered by the user, customer name, age, income level, color preference, previously purchased product, product category, product combination/bundle, previous inquired product, past delivery location, interaction channel, location of interaction, purchase time, delivery time, special requests, identity data, demographic data, social relationships, social network account names, social network publication or comments, interaction records with sales representatives, customer service representatives, or delivery personnel, preferences, dislikes, sentiment, beliefs, superstitions, personality, temperament, interaction style, etc.).

Each of the above identified elements may be stored in one or more of the previously mentioned memory devices, and corresponds to a set of instructions for performing a function described above. The above identified modules or programs (i.e., sets of instructions) need not be implemented as separate software programs, procedures, modules or data structures, and thus various subsets of these modules may be combined or otherwise re-arranged in various implementations. In some implementations, memory 506, optionally, stores a subset of the modules and data structures identified above. Furthermore, memory 506, optionally, stores additional modules and data structures not described above.

While particular embodiments are described above, it will be understood it is not intended to limit the application to these particular embodiments. On the contrary, the application includes alternatives, modifications and equivalents that are within the spirit and scope of the appended claims. Numerous specific details are set forth in order to provide a thorough understanding of the subject matter presented herein. But it will be apparent to one of ordinary skill in the art that the subject matter may be practiced without these specific details. In other instances, well-known methods, procedures, components, and circuits have not been described in detail so as not to unnecessarily obscure aspects of the embodiments.

What is claimed is:

1. A method, comprising:

at a device having a camera and one or more output devices, one or more processors, and memory:

obtaining one or more images of a rack configured to hold a plurality of objects in position while preset operations are performed on the plurality of objects inside a chamber, wherein placement of the plurality of objects on the rack is based on one or more characteristics of respective objects of the plurality of objects relative to one or more physical parameters of respective locations on the rack when the rack is placed within the chamber during the preset operations;

analyzing the one or more images to determine whether placement of one or more objects on the rack is suitable; and in accordance with a determination that respective placement of at least a first object on the rack is not suitable, generating a first output providing a guidance on proper placement of the first object on the rack, wherein the first output is generated by the device in accordance with the one or more characteristics of the first object relative to the one or more physical parameters of the respective locations on the rack, taking into account of one or more other objects already placed on the rack, wherein the one or more physical parameters of respective locations on the rack comprises a temperature distribution within the chamber during performance of the preset operations, and the temperature distribution is derived from raw sensor data comprising thermal map data.

2. The method of claim 1, wherein the rack is part of a dishwasher that performs preset dish washing operations on the plurality of objects when the rack is inserted into the dishwasher, and wherein the one or more physical parameters of respective locations on the rack comprises a position of a sprayer of the dishwasher inside the chamber.

3. The method of claim 1, wherein the one or more physical parameters of respective locations on the rack comprises a presence of an earlier loaded object that faces a first direction relative to a preset portion of the rack.

4. The method of claim 1, wherein the one or more physical parameters of respective locations on the rack prevents a concave surface of a respective object to face upward in the chamber.

5. The method of claim 1, wherein the device is a dishwasher that includes the camera.

6. The method of claim 1, wherein the device is a mobile device that has a user interface for selecting a model identifier corresponding to the rack, and the device retrieves the one or more physical parameters of respective locations on the rack in accordance with the model identifier selected by a user via the user interface.

7. The method of claim 1, wherein obtaining the one or more images of the rack configured to hold the plurality of objects in position while preset operations are performed on the plurality of objects inside the chamber is performed in response to detecting opening of the chamber.

8. The method of claim 1, wherein obtaining the one or more images of the rack configured to hold a plurality of objects in position while preset operations are performed on the plurality of objects inside a chamber is performed in response to detecting movement of an object toward the rack after the chamber is opened.

9. The method of claim 1, wherein obtaining the one or more images of the rack configured to hold a plurality of objects in position while preset operations are performed on the plurality of objects inside a chamber is performed in response to detecting movement of the rack into the chamber.

10. The method of claim 1, wherein obtaining the one or more images of the rack is performed during loading of a respective object onto the rack and after completion of loading for a respective object load.

11. The method of claim 10, wherein different sets of criteria are used for generating the first output depending on whether the violation is found during loading of the respective object or after the completion of the loading.

12. The method of claim 1, wherein the first output includes a first component that provides a recommendation or error correction instruction for the proper placement of the at least first object on the rack, and an explanation for the recommendation or error correction instruction.

13. The method of claim 1, wherein analyzing the one or more images to determine whether placement of one or more objects on the rack is suitable includes optimizing one or more performance parameters associated with the preset operations by adjusting a location and an orientation of a respective object on the rack and checking against one or more fixed rules regarding the location and the orientation of the respective object on the rack.

14. The method of claim 1, including:

obtaining an image of all objects that are to be loaded onto the rack from a mobile device prior to obtaining the one or more images of the rack, wherein the first output is generated by the device further in accordance to an analysis that takes into account other objects among all the objects that are to be loaded onto the rack but that have not already been placed on the rack.

* * * * *